US009936755B2

(12) United States Patent
Blakely et al.

(10) Patent No.: US 9,936,755 B2
(45) Date of Patent: Apr. 10, 2018

(54) ARTICLES OF APPAREL WITH AUXETIC FABRIC

(71) Applicant: Under Armour, Inc., Baltimore, MD (US)

(72) Inventors: Kyle Sanders Blakely, Baltimore, MD (US); Alan Toronjo, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 1113 days.

(21) Appl. No.: 14/137,250

(22) Filed: Dec. 20, 2013

(65) Prior Publication Data

US 2014/0109286 A1 Apr. 24, 2014

Related U.S. Application Data

(63) Continuation-in-part of application No. 13/838,827, filed on Mar. 15, 2013.

(60) Provisional application No. 61/695,993, filed on Aug. 31, 2012.

(51) Int. Cl.

| | |
|---|---|
| ***B32B 3/24*** | (2006.01) |
| ***A42B 1/22*** | (2006.01) |
| ***A43B 23/02*** | (2006.01) |
| ***A41D 31/02*** | (2006.01) |
| *A41D 13/00* | (2006.01) |
| *A45F 3/00* | (2006.01) |
| *A45C 3/00* | (2006.01) |

(52) U.S. Cl.

CPC ..... *A42B 1/22* (2013.01); *A41D 31/02* (2013.01); *A43B 23/027* (2013.01); *A43B 23/0215* (2013.01); *A41D 13/0015* (2013.01); *A41D 2400/82* (2013.01); *A45C 2003/002* (2013.01); *A45F 3/00* (2013.01); *Y10T 428/24273* (2015.01)

(58) Field of Classification Search

CPC ..... A43B 23/027; A41D 2400/82; Y10T 428/24273

See application file for complete search history.

(56) References Cited

U.S. PATENT DOCUMENTS

| | | | |
|---|---|---|---|
| 4,668,557 | A | 5/1987 | Lakes |
| 4,809,690 | A | 3/1989 | Bouyssi |
| 5,334,903 | A | 8/1994 | Smith |
| 5,661,854 | A | 9/1997 | March |

(Continued)

FOREIGN PATENT DOCUMENTS

| | | |
|---|---|---|
| FR | 2876879 | 4/2006 |
| JP | 10072719 A | 3/1998 |

(Continued)

OTHER PUBLICATIONS

European Search Report from EU Application No. 13179068, dated Nov. 20, 2013.

*Primary Examiner* — William P Watkins, III

(74) *Attorney, Agent, or Firm* — Maginot, Moore & Beck LLP

(57) ABSTRACT

A garment includes at least one garment panel made of a fabric including a first yarn having a first denier and a second yarn having a second denier, the first denier being greater than the second denier. The first yarn forms an auxetic structure comprising a pattern of interconnected segments on the garment panel. The second yarn forms a fill portion extending between the interconnected segments of the auxetic structure.

19 Claims, 13 Drawing Sheets

(56) References Cited

U.S. PATENT DOCUMENTS

| | | | |
|---|---|---|---|
| 5,937,441 | A | 8/1999 | Raines |
| 6,029,376 | A | 2/2000 | Cass |
| 6,247,181 | B1 | 6/2001 | Hirsch |
| 6,539,556 | B1 | 4/2003 | Barker |
| 6,783,814 | B2 | 8/2004 | Swager |
| 6,878,320 | B1 | 4/2005 | Alderson |
| 6,989,075 | B1 | 1/2006 | Kao |
| D521,191 | S | 5/2006 | Berger |
| 7,160,621 | B2 | 1/2007 | Chaudhari |
| 7,247,265 | B2 | 7/2007 | Alderson |
| 7,252,870 | B2 | 8/2007 | Anderson |
| 7,350,851 | B2 | 4/2008 | Barvosa-Carter |
| 7,455,567 | B2 | 11/2008 | Bentham et al. |
| 7,650,648 | B2 | 1/2010 | Roberts |
| 7,858,055 | B2 | 6/2010 | Lee |
| 7,824,763 | B2 | 11/2010 | Namburi |
| 7,896,294 | B2 | 3/2011 | Dittrich |
| 7,910,193 | B2 | 3/2011 | Ma |
| 7,989,057 | B2 | 8/2011 | Alderson |
| 8,074,418 | B2 | 12/2011 | Thiagarajan |
| 8,084,117 | B2 | 12/2011 | Lalvani |
| 8,304,355 | B2 | 11/2012 | Baldauf |
| 8,436,508 | B2 | 5/2013 | Kornbluh |
| 2002/0132543 | A1 | 9/2002 | Baer |
| 2005/0035031 | A1 | 2/2005 | Alderson |
| 2005/0159066 | A1 | 7/2005 | Alderson et al. |
| 2006/0129227 | A1 | 6/2006 | Hengelmolen |
| 2007/0031667 | A1 | 2/2007 | Hook |
| 2007/0093768 | A1 | 4/2007 | Roe |
| 2007/0213838 | A1 | 9/2007 | Hengelmolen |
| 2007/0286987 | A1 | 12/2007 | Anderson |
| 2008/0011021 | A1 | 1/2008 | Starbuck |
| 2008/0032598 | A1 | 2/2008 | Bentham et al. |
| 2008/0248710 | A1 | 10/2008 | Wittner |
| 2009/0041978 | A1 | 2/2009 | Sogard |
| 2009/0119820 | A1 | 5/2009 | Bentham |
| 2009/0239049 | A1 | 9/2009 | Hook |
| 2009/0265839 | A1 | 10/2009 | Young |
| 2010/0029796 | A1 | 2/2010 | Alderson |
| 2010/0107317 | A1 | 5/2010 | Wang |
| 2010/0305535 | A1 | 12/2010 | Leeming |
| 2010/0306904 | A1 | 12/2010 | Neid |
| 2011/0029063 | A1 | 2/2011 | Ma |
| 2011/0039088 | A1 | 2/2011 | Lee |
| 2011/0046715 | A1 | 2/2011 | Ugbolue |
| 2011/0059291 | A1 | 3/2011 | Boyce |
| 2011/0144417 | A1 | 6/2011 | Jagger |
| 2011/0155137 | A1 | 6/2011 | Martin |
| 2011/0156314 | A1 | 6/2011 | Alberg |
| 2011/0159758 | A1 | 6/2011 | Martin |
| 2011/0168313 | A1 | 7/2011 | Ma et al. |
| 2011/0209557 | A1 | 9/2011 | Burns |
| 2011/0214560 | A1 | 9/2011 | Skertchly |
| 2011/0236519 | A1 | 9/2011 | Skertchly |
| 2011/0250383 | A1 | 10/2011 | Summers |
| 2011/0252544 | A1 | 10/2011 | Abernethy |
| 2011/0265714 | A1 | 11/2011 | Lee |
| 2011/0281481 | A1 | 11/2011 | Alderson |
| 2011/0282452 | A1 | 11/2011 | Koerner |
| 2012/0029537 | A1 | 2/2012 | Mortarino |
| 2012/0055187 | A1 | 3/2012 | Raines |
| 2012/0060991 | A1 | 3/2012 | Mun |
| 2012/0066820 | A1 | 3/2012 | Fresco |
| 2012/0129416 | A1 | 5/2012 | Anand |
| 2013/0071583 | A1 | 3/2013 | Evans |
| 2013/0134992 | A1 | 5/2013 | Zhu |

FOREIGN PATENT DOCUMENTS

| | | | |
|---|---|---|---|
| JP | 2007138320 | A | 6/2007 |
| WO | 2010082537 | S1 | 7/2010 |
| WO | 2012069787 | | 5/2012 |

ARTICLES OF APPAREL WITH AUXETIC FABRIC

CROSS-REFERENCE TO RELATED APPLICATIONS

This application is a continuation-in-part of U.S. application Ser. No. 13/838,827, filed Mar. 15, 2013, which claims priority from U.S. Provisional Patent Application No. 61/695,993, filed Aug. 31, 2012. The disclosure of each aforementioned application is incorporated herein by reference in its entirety.

FIELD

This document relates to the field of apparel, and particularly to garments and other articles of apparel to be carried or worn by a human, including bags, shirts, pants, hats, gloves, and footwear.

BACKGROUND

Many garments are designed to fit closely to the human body. When designing an article of apparel for a close fit to the human body, different body shapes and sizes must be considered. Different individuals within a particular garment size will have different body shapes and sizes. For example, two individuals wearing the same shoe size may have very differently shaped heels. As another example, two individuals wearing the same shirt size may have very different chest to abdomen dimensions. These variable measurements between similarly sized individuals makes proper design of closely fitting garments difficult.

In addition to accounting for different body measurements for different individuals within a size, various contours of the human body must also be considered when designing closely fitting articles of apparel. These contours of the human body often include various double curvature surfaces. Spheroids, bowls, and saddle-backs are all examples of surfaces having double curvatures. If a garment is not properly sized for a particular wearer, the wearer may experience undesirable tightness or looseness at various locations. Such an improper fit may result in discomfort, excessive wear, buckling, bending or creasing of the garment at the poorly fitting locations.

The contour and fit of a particular of apparel may be further complicated by the desire to use comfortable fabrics for the article of apparel. While some materials such as cotton are typically comfortable against human skin, the material wrinkles easily and does not easily conform to body contours. Materials such as cotton are also poor perspiration managers, as they tend to absorb perspiration and retain moisture against the skin.

In view of the foregoing, it would be desirable to provide a garment or other article of apparel comprised of a fabric that is capable of conforming to various body shapes within a given size range. It would also be desirable to provide a fabric that is capable of conforming to various double curvatures on the human body. Furthermore, it would be advantageous for such fabric to be comfortable against human skin while also managing perspiration and moisture for the wearer. In addition, it would be desirable for such a garment or article of apparel to be attractive, relatively inexpensive and easy to manufacture.

SUMMARY

In accordance with one exemplary embodiment of the disclosure, there is provided a garment comprising at least one garment panel. The garment panel is comprised of a fabric including a first yarn having a first denier and a second yarn having a second denier, wherein the first denier greater than the second denier. The first yarn forms an auxetic structure comprising a pattern of interconnected segments on the garment panel. The second yarn forms a fill portion extending between the interconnected segments of the auxetic structure.

Pursuant to another exemplary embodiment of the disclosure, there is provided a garment comprising at least one panel. The at least one panel is comprised of a first material having a first modulus of elasticity and a second material having a second modulus of elasticity, wherein the first modulus of elasticity greater than the second modulus of elasticity. An auxetic structure comprising a pattern of reentrant shapes is provided by the first material on the panel. A fill portion is provided by the second material on the panel. The fill portion is positioned inside of each reentrant shape of the auxetic structure.

In accordance with yet another exemplary embodiment of the disclosure, there is provided a garment comprising a torso panel and a limb panel connected to the torso panel. The torso panel is comprised of a fabric including an auxetic structure and a fill portion, wherein the auxetic structure is arranged in a latitudinal direction on the torso panel. The limb panel is comprised of the fabric including the auxetic structure, but the auxetic structure arranged in a longitudinal direction on the limb panel. The fabric includes a first yarn having a first denier, a second yarn having a second denier that is less than the first denier, and a third yarn comprised of elastane fibers. The auxetic structure is comprised of the first yarn and the third yarn, and the fill portion is comprised of the second yarn and the third yarn.

The above described features and advantages, as well as others, will become more readily apparent to those of ordinary skill in the art by reference to the following detailed description and accompanying drawings. While it would be desirable to provide an article of apparel that provides one or more of these or other advantageous features, the teachings disclosed herein extend to those embodiments which fall within the scope of the appended claims, regardless of whether they accomplish one or more of the above-mentioned advantages.

DESCRIPTION

As described herein, an article of apparel includes an auxetic structure incorporated therein. The term "article of apparel" as used herein refers to any garment, footwear or accessory configured to be worn on or carried by a human. Examples of articles of apparel include helmets, hats, caps, shirts, pants, shorts, sleeves, knee pads, elbow pads, shoes, boots, backpacks, duffel bags, cinch sacks, and straps, as well as numerous other products configured to be worn on or carried by a person.

The term "auxetic" as used herein generally refers to a material or structure possessing a negative Poisson's ratio. In other words, when stretched, auxetic materials expand, becoming thicker (as opposed to thinner), in a direction perpendicular to the applied force. In at least one embodiment, this expansion occurs due to inherent hinge-like structures within the materials which flex when stretched. In contrast, materials with a positive Poisson's ratio contract in a direction perpendicular to the applied force.

Exemplary Auxetic Structures

Figure 1A:
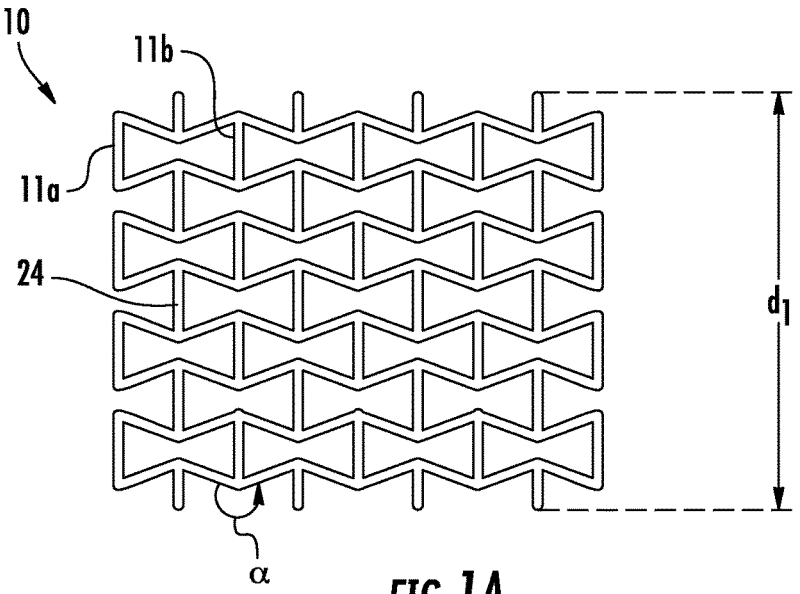
FIG. 1A is a plan view of an auxetic structure including segments and voids forming a plurality of reentrant shapes.
Figure 1B:
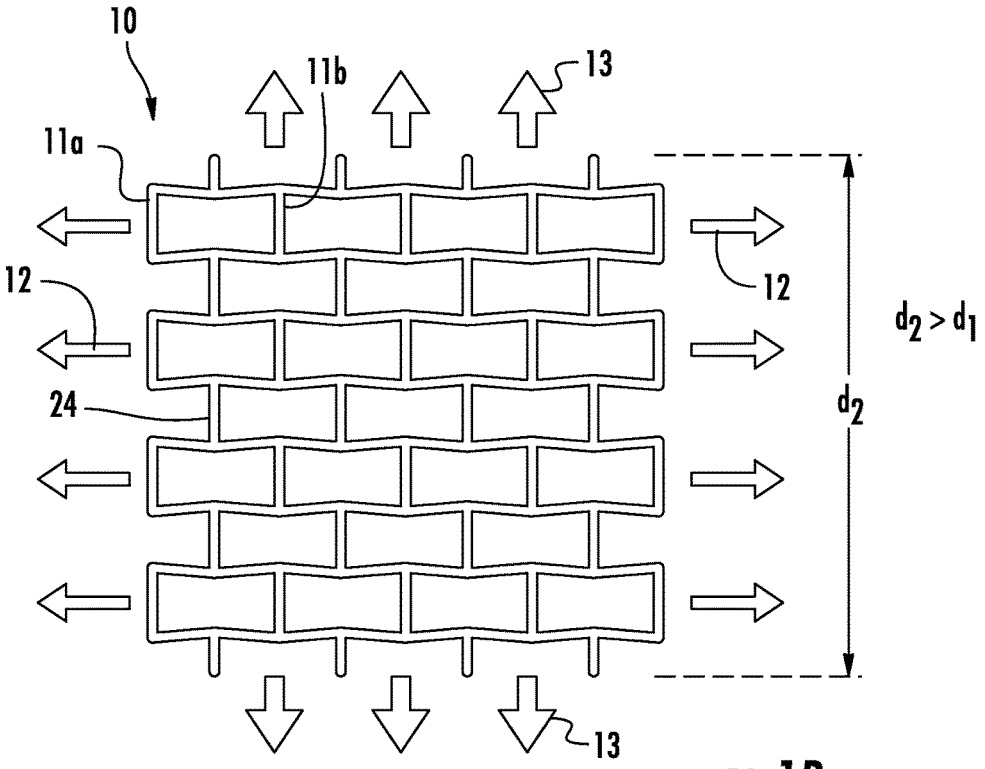
FIG. 1B is a plan view of the auxetic structure of FIG. 1A in an expanded position.

One exemplary auxetic structure 10 is shown in FIGS. 1A and 1B. The auxetic structure 10 is provided by a plurality of generally-polygon-shaped cells (e.g., hourglass or bow-tie shaped cells, which may also be referred to as "auxetic hexagons"). The cells are oriented in an array, being positioned in horizontal rows and vertical columns. FIG. 1A shows the auxetic structure 10 in its normal, unstretched state. The thickness (or width) of the auxetic structure in the unstretched state is indicated as d1. FIG. 1B shows the auxetic structure 10 stretched in the direction of arrows 12. The thickness of the auxetic structure in the stretched state is indicated by d2. As can be seen in FIG. 1B, when tension is applied along a first direction (indicated by arrows 12), the auxetic structure is stretched, expanding (becoming thicker) in a second direction perpendicular to the first direction 12 (indicated by arrows 13) such that, in the stretched state d2>d1. In the embodiment of FIGS. 1A and 1B, this phenomena is the result of the pivoting/rotation that occurs along the vertices of the shape, i.e., where the corners of the polygon intersect.

It will be recognized that whether a structure has a negative Poisson's ratio, may depend upon the degree to which the structure is stretched. Structures may have a negative Poisson's ratio up to a certain stretch threshold, but when stretched past the threshold may have a positive Poisson's ratio. For example, it is possible that when the auxetic structure 10 in FIG. 1A is stretched in the direction of arrows 12 past a threshold expansion position (e.g., past the state shown in FIG. 1B), the cells and segments of the auxetic structure 10 may be stretched to an extent that the auxetic structure 10 becomes slightly thinner (in the direction perpendicular to arrows 12) before the structure is torn apart or otherwise damaged. Accordingly, the term "auxetic" as used herein refers to structures or materials that possess or exhibit a negative (below zero) Poisson's ratio at some point during stretch. Preferably, the structure or material possesses a negative Poisson's ratio during the entirety of the stretch. The term "near auxetic," moreover, is used herein to refer to a structure having a Poisson's ratio of approximately zero and, in particular, less than +0.15 (i.e., from about 0 to +0.15).

Auxetic structures are formed from a plurality of interconnected segments forming an array of cells, and each cell having a reentrant shape. In the field of geometry, a reentrant shape may also be referred to as a "concave", or "non-convex" polygon or shape, which is a shape having an interior angle with a measure that is greater than 180°. The auxetic structure 10 in FIGS. 1A and 1B is an example of such a structure including a reentrant shape. As shown, angle $\alpha$ possesses a measurement of greater than 180°.

Auxetic structures may be defined by two different elongation directions, namely, a primary elongation direction and a secondary elongation direction. The primary elongation direction is a first direction along which the cells of the auxetic structure are generally arranged, and the secondary elongation direction is the direction perpendicular to the first direction, the cells of the auxetic structure also being arranged along this second direction. For example, in FIGS. 1A and 1B, the horizontal arrows 12 (from the viewpoint of FIG. 1B define the primary elongation direction, while vertical arrows 13 (from the viewpoint of FIG. 1B) define the secondary elongation direction. When a tension force elongates the auxetic structure 10 in the primary elongation direction, the auxetic structure is also elongated in the secondary elongation direction. Similarly, applying tension to the auxetic structure 10 in the secondary elongation direction will result in elongation in the primary elongation direction.

The total number of cells, the shape of each shell, and the overall arrangement of the cells within the structure generate the expansion pattern of the auxetic structure. That is, the arrangement and shape of the cells determine whether the auxetic structure 10 expands a greater amount in the primary elongation direction or the secondary elongation direction.

It is worth noting that the phrases "primary elongation direction" and "secondary elongation direction" as used herein do not necessarily indicate that the auxetic structure 10 elongates further in one direction or the other, but is merely used to indicate two general directions of elongation for the auxetic structure as defined by the cells, with one direction being perpendicular to the other. Accordingly, the term "primary elongation direction" is used merely for convenience to define one direction of stretch. However, once one direction of stretch is defined as the "primary elongation direction", the term "secondary elongation direction", as used herein, refers to a direction that is perpendicular to the primary elongation direction. For example, for auxetic structures having polygon shaped cells with two or more substantially parallel opposing edges, such as those shown in FIGS. 1A and 1B (e.g., edges 11*a* and 11*b* in FIGS. 1A and 1B), the primary elongation direction may be considered to be a line that extends perpendicularly through the substantially parallel opposing edges (e.g., edges 11*a* and 11*b*) of the cells. Thus, in the auxetic structure of FIGS. 1A and 1B, the primary elongation direction may be defined by arrows 12. However, as noted above the primary elongation direction may alternatively be defined to be the perpendicular direction defined by arrows 13. In either case, the secondary elongation direction is the direction perpendicular to the primary elongation direction.

Auxetic Arrangements Including Auxetic Layer Disposed on Base Layer

In at least one embodiment, an auxetic arrangement 14 includes an auxetic structure 10 mounted on a flexible, resilient substrate. The auxetic structure 10 is an open framework capable of supporting the substrate and directing the substrate's expansion under a load. Accordingly, the auxetic structure, though flexible, may be more stiff than the substrate (i.e., the segments forming the auxetic structure 10 possess a higher elastic modulus than the substrate). The substrate, moreover, is generally more elastic than the auxetic structure in order to return the structure to its original state upon removal of the tensile strain.

Figure 2A:
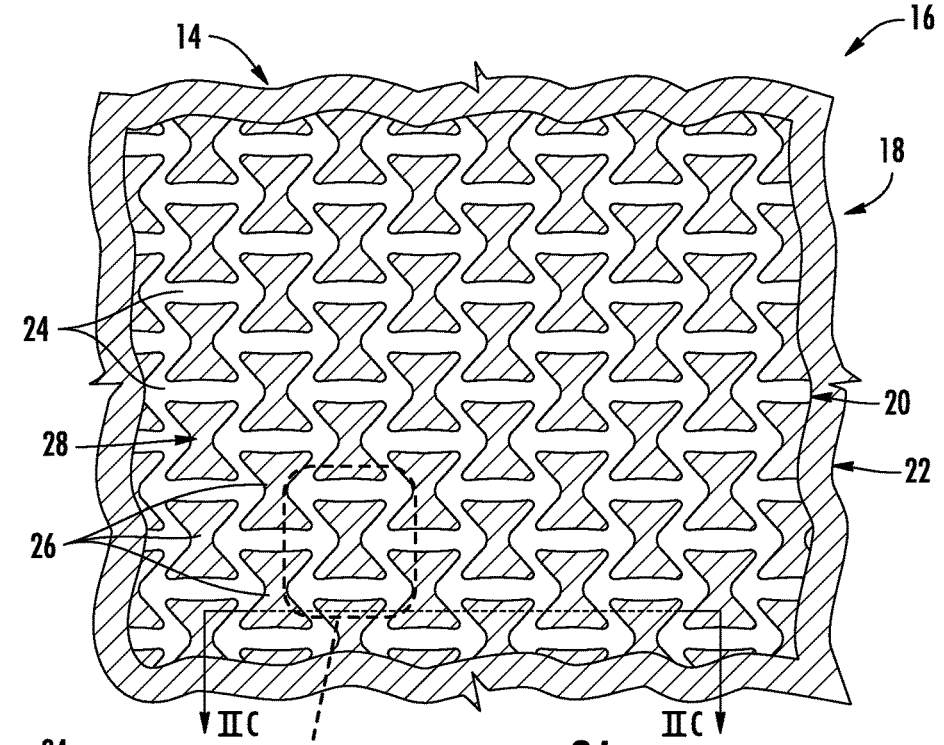
FIG. 2A is a panel of an article of apparel including an auxetic arrangement with the auxetic structure of FIG. 1A.
Figure 2B:
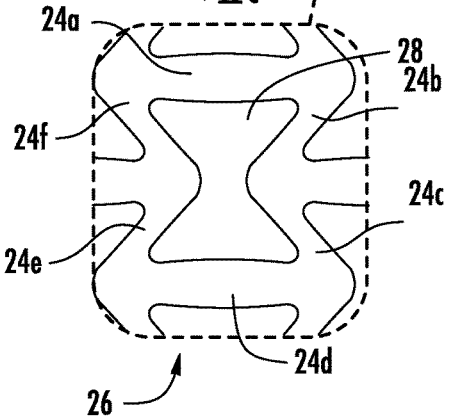
FIG. 2B is an enlarged, schematic view of the auxetic arrangement of FIG. 2A, showing dimensions of the arrangement.
Figure 2B:
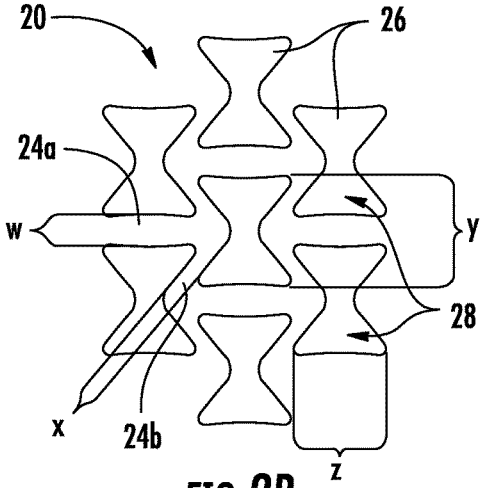
Figure 2C:
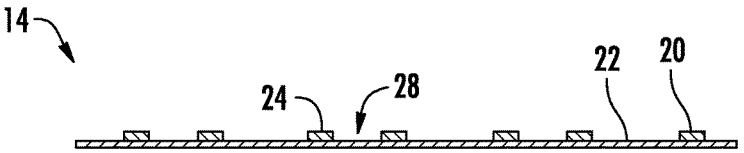
FIG. 2C is a cross-sectional view of an exemplary embodiment of the auxetic arrangement of FIG. 2A.

With reference now to FIGS. 2A-2C, in at least one exemplary embodiment, an article of apparel 16 includes an auxetic arrangement 14 incorporated into at least one panel, such as a garment panel 18, or other portion with of the article of apparel. The auxetic arrangement 14 is comprised of a first or auxetic layer 20 coupled to a second or resilient layer 22 (the second layer 22 is shown under the first layer 20 in FIG. 2A). The second layer 22 may also be referred to as a "substrate layer" or a "base layer."

The auxetic layer 20 includes the auxetic structure 10. Specifically, the auxetic layer 20 (and thus, the auxetic structure 10) is a plurality of segments 24 arranged to provide a repeating pattern or array of cells 26, each cell possessing a reentrant shape. Specifically, each cell 26 is defined by a set of interconnected structural members 24*a*, 24*b*, 24*c*, 24*d*, 24*e*, 24*f*, with an aperture or void 28 formed in the center of the cell 26. The void 28 exposes the second layer 22 to which the first layer 20 is coupled. Accordingly, the auxetic layer 20 is a mesh framework defined by segments 24 and voids 28.

Figure 3A:
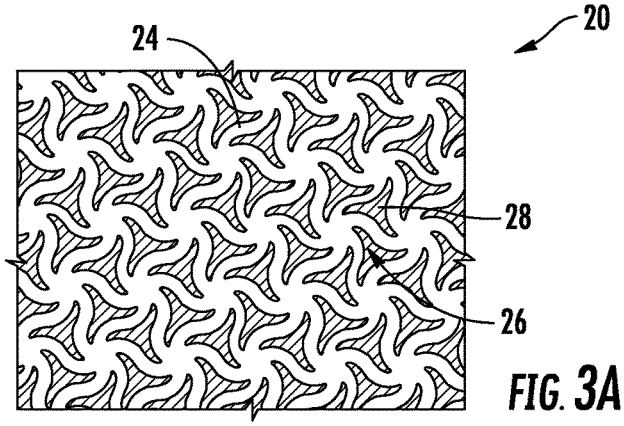
FIG. 3A is a plan view of an alternative embodiment of the auxetic structure of FIG. 1A.
Figure 3B:
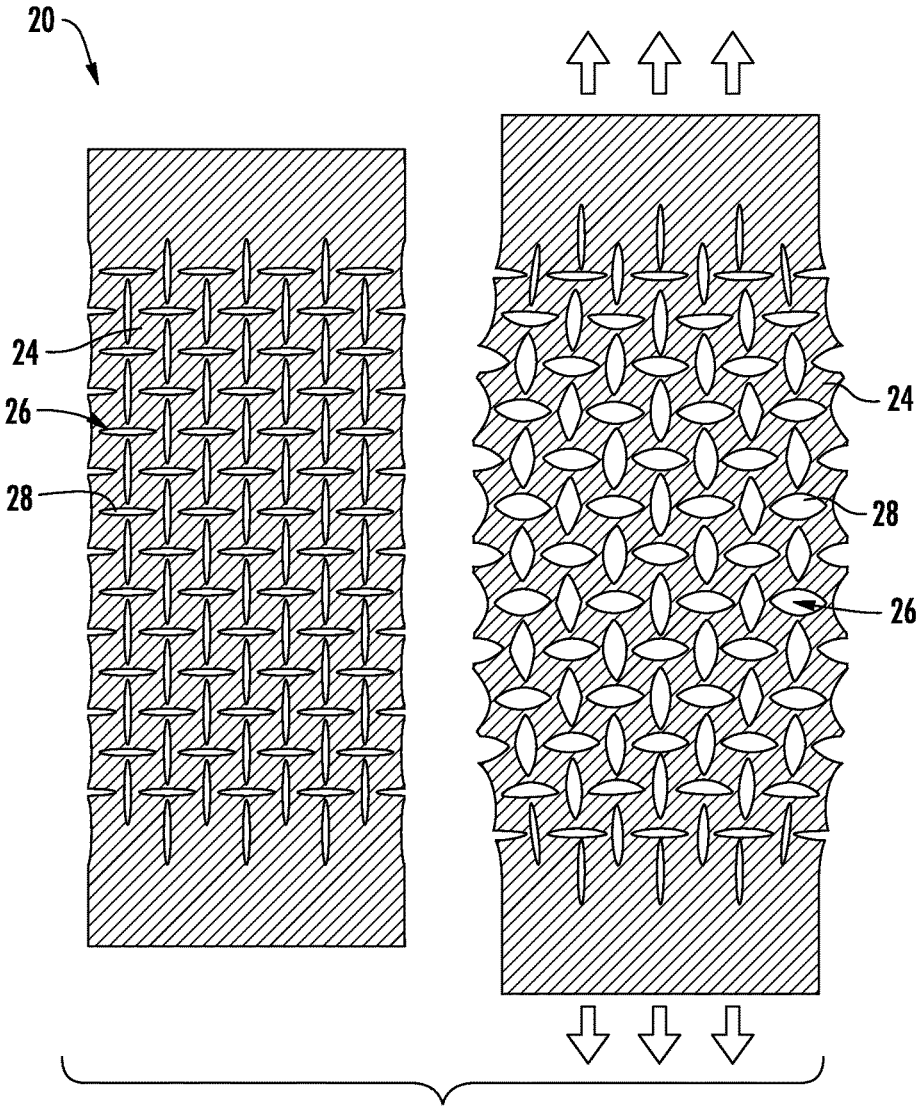
FIG. 3B is a plan view of another alternative embodiment of the auxetic structure of FIGS. 3A and 3B.

In at least one embodiment, the auxetic layer 20 is unitary structure, with each cell 26 sharing segments 24 with adjacent cells. The cells 26 form an array of reentrant shapes, including a plurality of rows and columns of shapes defined by the voids 28. In the embodiment of FIG. 2A, the reentrant shapes are bow-tie shapes (or auxetic hexagon shapes, similar to the shapes shown in FIGS. 1A and 1B). However, it will be recognized by those of ordinary skill in the art that the cells 26 of the auxetic structure may include differently shaped segments or other structural members and differently shaped voids. FIGS. 3A-3B show two exemplary alternative auxetic structures. In FIG. 3A, the cells 26 of the auxetic layer 20 have a twisted triangular or triangular vortex shape, and the interconnected structural members are curved segments. In FIG. 3B, the cells 26 are oval shaped, and the interconnected structural members are rectangular or square structures.

In at least one embodiment, the segments 24 possess uniform dimensions. With reference again to the exemplary embodiment of FIGS. 2A and 2B, in an embodiment, the segments 24 forming the cells 26 (i.e., the cell structural members 24*a*-24*f*) are not necessarily uniform in shape and thickness. In particular, as shown in FIG. 2B, segment 24*a* is slightly bowed or convex along its length while segment 24*b* is substantially straight along its length. Segment 24*a* has a width, w, of between 1 mm and 5 mm, and particularly 3 mm. Segment 24*b* has a width, x, between 0.5 mm and 4 mm, and particularly 2 mm. While the segments 24 may vary somewhat in size and shape, the voids 28 are substantially uniform in size and shape. In the embodiment of FIG. 2B, the cell voids 28 have a height, y, between 6 and 12 mm, and particularly about 9.3 mm. The cell voids 28 have a width, z, between 6 and 12 mm, and particularly about 8.8 mm. Although not illustrated in FIG. 2B, the cross-sectional thickness of each segment 24 may be between 0.5 mm and 5 mm, and more specifically in some embodiments, between 1 mm and 2 mm, and particularly about 1.5 mm.

The auxetic layer 20 may be formed of any materials suitable for its described purpose. In an embodiment, the segments 24 are formed of any of various different resilient materials. In at least one exemplary embodiment, the segments 24 are comprised of a polymer such as ethylene-vinyl acetate (EVA), a thermoplastic such as nylon, or a thermoplastic elastomer such as polyurethane. Each of these materials possesses elastomeric qualities of softness and flexibility.

In another exemplary embodiment, the segments 24 are comprised of foam, such as a thermoplastic polyurethane (TPU) foam or an EVA foam, each of which is resilient and provides a cushioning effect when compressed. While EVA and TPU foam are disclosed herein as exemplary embodiments of the auxetic layer 20, it will be recognized by those of ordinary skill in the art that the auxetic layer 20 may alternatively be comprised of any of various other materials. For example, in other alternative embodiments, the auxetic layer may be comprised of polypropylene, polyethylene, XRD foam (e.g., the foam manufactured by the Rogers Corporation under the name PORON®), or any of various other polymer materials exhibiting sufficient flexibility and elastomeric qualities. In a further embodiment, the foam forming the auxetic layer is auxetic foam.

The segments 24 of the auxetic layer 20 may be formed in any of various methods. By way of example, the auxetic layer 20 is formed via a molding process such as compression molding or injection molding. By way of further example, the auxetic layer is formed via an additive manufacturing process such as selective laser sintering (SLS). In SLS, lasers (e.g., $CO_2$ lasers) fuse successive layers of powdered material to form a three dimensional structure. Once formed, the auxetic layer 20 coupled (e.g., attached or mounted) to the base layer 22. Specifically, the auxetic layer 20 may be connected to the base layer 22 using any of various connection methods (examples of which are described in further detail below).

In at least one embodiment, the auxetic layer 20 is printed directly on to the base layer 22 using any of various printing methods, as will be recognized by those of ordinary skill in the art. Alternatively, the auxetic layer 20 may first be printed on a transfer sheet, and then a heat transfer method may be used to transfer the auxetic layer to the base layer 22.

As mentioned above, in at least one exemplary embodiment, the void 28 of each cell 26 in the auxetic layer 20 exposes the second layer 22 through the auxetic layer. In an alternative embodiment, the void 28 is filled with material such as an elastic material (e.g., a hot melt or other thermoplastic material) that partially or substantially fills the void 28 at the interior portion of the cell between the outer walls (i.e., the segments 24). The elastic material differs from the material forming the segments 24 of the auxetic layer. Filling the void with elastic material increases the resiliency of the auxetic structure. In contrast, a void 28 without material results in a more expansive auxetic structure 10 (compared to a filled void).

In order to design the auxetic layer 20 with desirable qualities, a number of design considerations must be balanced. These design considerations include, for example, the proximity of negative space (i.e., the proximity of the voids 28 associated with each cell 26), the cell size, the stroke distance (i.e., the distance a cell expands between a retracted position and a fully extended position), the mass, elasticity and strength of the material used for the cell walls. These design considerations must be carefully balanced to produce an auxetic structure with the desired qualities. For example, for a given material, if the voids in each cell are too large, the auxetic structure may be undesirably weak and flimsy. For the same material, if the voids in each cell are too small, the auxetic structure may be undesirably rigid and resistant to expansion. In at least one embodiment, it is desirable for the auxetic layer 20 to be more dominant than the base layer 22 such that application of a stress to the auxetic arrangement 14 will result in the more submissive base layer 22 conforming to any changes in the more dominant auxetic layer 20. Accordingly, in such embodiment, the cell walls must be designed such that the resulting auxetic layer 20 will be more dominant than the material of the base layer 22.

The base layer 22 is a flexible, resilient layer operable to permit the expansion of the auxetic layer 20 when tension is applied to the arrangement 14. Typically, the base layer 22 is an inner layer facing and/or contacting the wearer of the apparel. In an embodiment, the base layer 22 comprises a resilient material having selected stretch capabilities, e.g., four-way or two-way stretch capabilities. A material with "four way" stretch capabilities stretches in a first direction and a second, directly-opposing direction, as well as in a third direction that is perpendicular to the first direction and a fourth direction that is directly opposite the third direction. In other words, a sheet of four-way stretch material stretches in both crosswise and lengthwise. A material with "two way" stretch capabilities, in contrast, stretches to some substantial degree in the first direction and the second, directly opposing direction, but will not stretch in the third and fourth directions, or will only stretch to some limited degree in the third and fourth directions relative to the first and second directions (i.e., the fabric will stretch substantially less in the third and fourth directions than in the first direction and second directions). In other words, a sheet of two-way stretch material stretches either crosswise or lengthwise.

By way of example, the base layer 22 is formed of a four-way stretch fabric such as elastane fabric or other compression material including elastomeric fibers. By way of further example, the base layer 22 is comprised of the compression material incorporated into garments and accessories sold by Under Armour, Inc. as HEATGEAR or COLDGEAR compression fabric. In other embodiments, the base layer 22 is comprised of an elastic fabric having limited stretch properties, such as a two-way stretch fabric.

Selection of the base layer 22 relative to the auxetic layer 20 permits the control of the base layer stretch pattern and/or the auxetic layer stretch pattern (discussed in greater detail below).

It should be understood that, while the base layer 22 has been described as being formed of a stretch fabric, in other embodiments, the base layer may be comprised of other resilient materials, including any of various elastomers such as thermoplastic polyurethane (TPU), nylon, or silicone (e.g., a plastic sheet formed of resilient plastic). Furthermore, when the base layer is comprised of an elastomer, the base layer 22 may be integrally formed with the auxetic layer 20 to provide a continuous sheet of material that is seamless and without constituent parts, with the generally solid base layer on one side of the material and the auxetic structure on the opposite side of the material.

The auxetic layer 20 is coupled (e.g., mounted, attached, or fixed) to the base layer 22. By way of example, the auxetic layer 20 is an elastomer sheet bonded or otherwise directly connected to a stretch fabric base layer 22 such that the two layers 20 and 22 function as a unitary structure. To this end, the auxetic layer 20 may be connected to the base layer 22 via adhesives, molding, welding, sintering, stitching or any of various other means. In an embodiment, the auxetic layer 20 is brought into contact with the base layer 22 and then heat is applied to place the material forming the auxetic layer in a semi-liquid (partially melted) state such that material of the auxetic layer in contact with the base layer infiltrates the base layer fabric. Alternatively, the auxetic layer is applied in a molten or semi-molten state. In either application, once cooled, the auxetic layer 20 is securely fixed (permanently connected) to the fibers of the base layer 22 such that any movement of the base layer is transferred to the auxetic layer, and vice versa.

This structure including the auxetic layer 20 and the base layer 22—has been found to provide improved contouring properties around a three-dimension object compared to a structure including only the base layer. For example, when incorporated into an article of apparel 16 (e.g., a compression garment), the apparel easily and smoothly conforms to the various shapes and curvatures present on the body. The auxetic arrangement 14 is capable of double curvature forming synclastic and/or anticlastic forms when stretched. Double curvatures are prevalent along the human form. Accordingly, the auxetic arrangement 14 will follow the curvatures of the body with little to no wrinkling or folding visible to the wearer. Without being bound to theory, it is believed that the auxetic layer 20 cooperates with the base layer 22 to expand along two axes while tightly conforming to the surface of the wearer (e.g., to the wearer's foot, arm, leg, head, etc.).

With various configurations of the auxetic arrangement, then, it is possible to control the overall stretch/expansion pattern of the auxetic arrangement 14 by combining the individual properties of the auxetic layer 20 and the base layer 22. By way of example, it is possible to provide a non-auxetic layer with auxetic properties. In an embodiment, the base layer 22 is four-way stretch material that, by itself, is not auxetic (i.e., it exhibits a positive Poisson's ratio under load). Accordingly, when the base layer is separated from the auxetic layer and tension is applied across the base layer material, the base layer material contracts in the direction perpendicular to the applied tension. Superimposing the auxetic layer 20 over the base layer 22, however, provides a framework sufficient to drive the expansion pattern of the base layer. As a result, the base layer 22 in the combined structure (i.e., in the arrangement 14) will now follow the expansion pattern of the auxetic structure 10, expanding not only along the axis of the applied tensile strain, but also along the axis perpendicular to the axis of the applied tensile strain. The resiliency of the base layer 22, moreover, optimizes the contouring ability of the entire arrangement 14 since it tightly conforms to the surface of the wearer. Furthermore, the base layer 22, being resilient, limits the expansion of the auxetic layer 20 to that necessary to conform to the object. That is, the base layer 22, while permitting expansion of the auxetic layer 20, will draw the layer back towards its normal/static position. Accordingly, over expansion of the auxetic layer 20 is avoided.

Additionally, it is possible to limit the auxetic properties of the auxetic structure by selecting an appropriate base layer 22. When forming apparel 16 (e.g., footwear), while expansion is desired, it is often desirable to limit the degree of expansion along one or more axes. By selecting a base layer 22 of two-way stretch material, it is possible to limit the expansion along a selected axis. Specifically, mounting an auxetic layer 20 onto a base layer 22 formed of two-way stretch material permits the expansion of the auxetic arrangement 14 along an axis parallel to the two-way stretch direction of the base layer 22, but limits expansion of the arrangement along an axis perpendicular to the two-way stretch direction of the base layer 22. Accordingly, application of a tension along the two-way stretch direction of the base layer 22 results in significant expansion of the auxetic arrangement 14 along the two-way stretch direction, but only limited or no expansion of the auxetic arrangement along the axis perpendicular to the two-way stretch direction. Application of a tension along the axis perpendicular to the two way stretch direction results in limited or no expansion of the auxetic arrangement in either direction. In this manner, an article of apparel may possess a customized stretch direction, including a plurality of auxetic arrangements selected and position to provide optimum stretch properties to the apparel.

Thus, in embodiments where the base layer 22 has two-way or four-way stretch properties, the orientation of the base layer 22 relative to the auxetic layer 20 may have an effect on the overall stretch properties of the auxetic structure. For example, consider a panel 18 with a base layer 22 having two-way stretch properties configured such that the two way stretch direction of the base layer 22 is aligned with a stretch direction of the auxetic layer 20 (e.g., the two-way stretch direction of the base layer 22 is aligned with the arrows 12 shown on the auxetic structure 10 in the embodiment of FIG. 1B). The Poisson's ratio exhibited by this panel 18 may tend to be closer to zero, or "near zero", than would be exhibited by a panel 18 including a base layer 22 with four-way stretch properties. In particular, because the base layer 22 limits stretch in the perpendicular direction (e.g., in the direction of arrows 13 in FIG. 1B), the stretch of the panel 18 will be limited in this perpendicular direction, thus keeping the Poisson's ratio for the panel closer to zero.

Finally, the combined structure including the auxetic layer 20 attached to the base layer 22 forms a more supportive structure than either layer alone. That is, the auxetic layer 20 described above provides an open framework that functions as a support structure for the article of apparel 16. For example, when used to form an upper in an article of footwear, the combined structure may be generally self-supporting. In other embodiments, the auxetic arrangement 14 possesses greater structure than the base layer 22 alone.

Auxetic Structure on Skull Cap

Figure 4A:
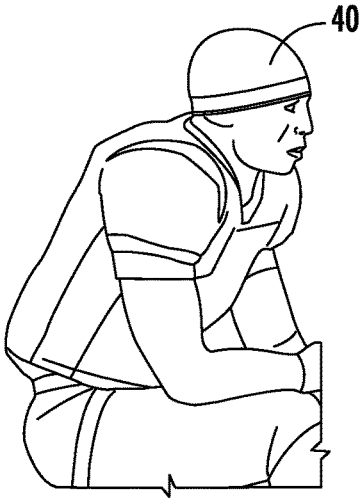
FIG. 4A is a perspective view of an article of apparel incorporating the auxetic arrangement of FIG. 2A in a cap.
Figure 4B:
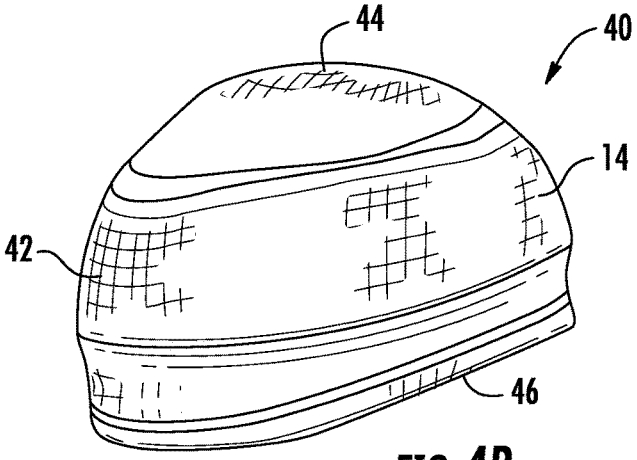
FIG. 4B is a side view of the cap of FIG. 4A.
Figure 4C:
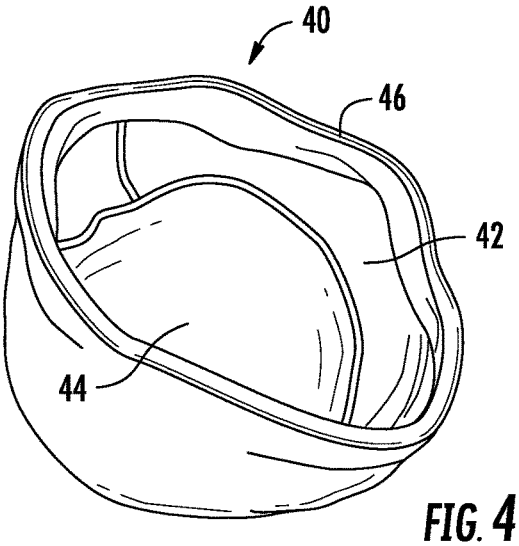
FIG. 4C is a bottom perspective view of the cap of FIG. 4B.

With reference now to FIGS. 4A-4C, in at least one exemplary embodiment, the auxetic arrangement 14 described herein may be incorporated into skull caps 40 commonly worn under a football helmet. The skull cap 40 is used to provide additional protection for the wearer's head as well as allowing a tight fitting football helmet to more easily slip over the head. The auxetic arrangement 14 may be provided in various forms and in various locations on the cap 40. For example, the auxetic arrangement may include the elastic base layer 22 and the auxetic layer 20, as described above, incorporated into the crown or a middle region of the cap 40. The combination of the elastic base layer 22 in combination with the auxetic layer 20 having a negative Poisson's ratio allows the skull cap to closely fit a large number of different head sizes.

Additionally, protection can be provided to the wearer by providing an arrangement including the auxetic layer 20 and a shock absorbing foam material disposed on the base layer 22. The auxetic layer 20, in combination with the shock absorbing foam material, provides additional padding to protect the head from impacts commonly experienced during training or competition.

In the exemplary embodiment of FIGS. 4A-4C, the auxetic layer 20 is positioned adjacent to at least one compression layers, such as base layer 22. Also, the auxetic arrangement 14 may be provided over the entire skull cap 40, or only over a portion of the skull cap. For example, the auxetic arrangement 14 may form the crown 44 of the cap. Alternatively or in addition, the auxetic arrangement may form a middle area 42 of the cap 40, between an upper crown portion 44 and a lower edge 46 of the cap 40.

Footwear with Auxetic Structure

With reference now to FIGS. 5A-8C, in an embodiment, the auxetic arrangement 14 is incorporated into a shoe. Traditionally, shoe uppers are patterned and cut in two-dimensional panels, and these two-dimensional panels are stitched together to form a general three-dimensional shape. With these traditional shoe uppers, the generic shape of the upper is often ill-fitting in specific areas that are difficult to form such as heel, ankle, arch, toes and instep. Accordingly, the auxetic arrangement 14 disclosed herein may be advantageously used to form various portions of shoes because the auxetic arrangement 14 is configured to smoothly fit multiple curvatures on the wearer without the need for numerous seams or cuts in the material. The auxetic arrangement 14 may be used to form a complete shoe upper or limited portions of the shoe upper, including the heel, ankle, arch, toes and instep.

Figure 5A:
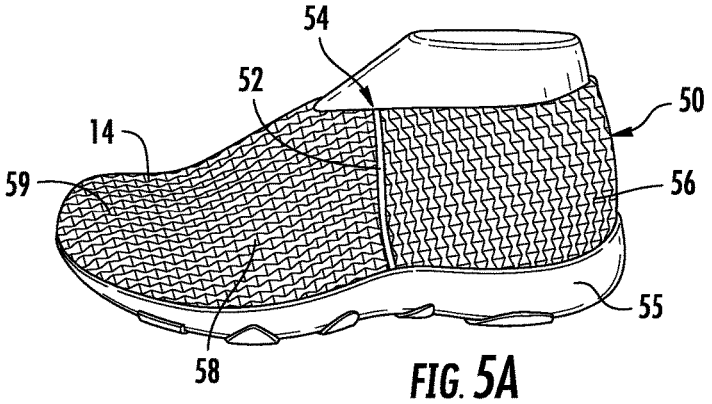
FIG. 5A is a side view of an article of footwear showing an upper incorporating an auxetic arrangement.
Figure 5B:
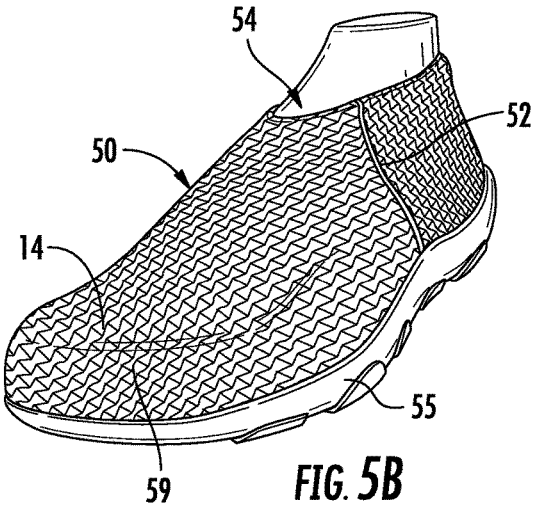
FIG. 5B is a front perspective view of the article of footwear of FIG. 5A.
Figure 5D:
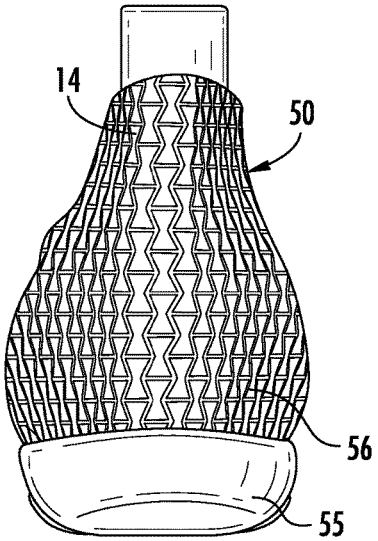
FIG. 5D is a rear view of the article of footwear of FIG. 5A.
Figure 5C:
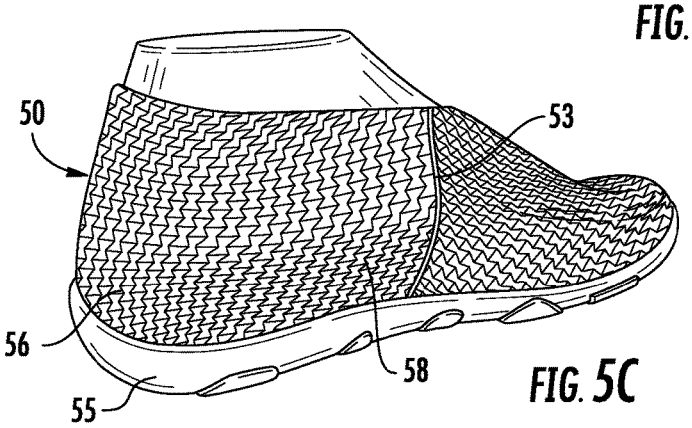
FIG. 5C is a side perspective view of the article of footwear of FIG. 5A.

FIGS. 5A-5D illustrate one exemplary embodiment of the auxetic arrangement 14 used to form a fully auxetic shoe upper 50 with customized fit. As shown in FIGS. 5A-5D, the auxetic arrangement 14 may be cut into two panels having predetermined shapes, the panels contoured into the shape of a foot, and then joined along a medial seam 52 and a lateral seam 53 (see FIGS. 5B and 5C) to form the shoe upper 50 with opening 54 to receive the foot. The auxetic arrangement 14 described above, including the auxetic layer 20 in combination with the elastic base layer 22, is easily manipulated to form the multiple curved surfaces required for the shoe upper 50. As shown in the figures, it is possible to form the complete shoe upper 50 from only two pieces of the auxetic arrangement without wrinkling or folding of the material. These two pieces on the shoe upper 50 cover the entire foot, including the heel 56, midfoot 58 and toe regions 59. Although the embodiment of FIGS. 5A-5D shows a two-piece construction, in at least one alternative embodiment, a shoe upper with a one-piece construction may be formed using the auxetic arrangement 14 described herein. Once the shoe upper 50 is formed, it may be joined to a sole member 55, as shown in FIGS. 5A and 5B. Because of the auxetic arrangement 14, the shoe upper 50 has an elastic, expandable nature, allowing the shoe upper to provide a comfortable yet secure fit to various foot sizes and shapes.

Figure 6A:
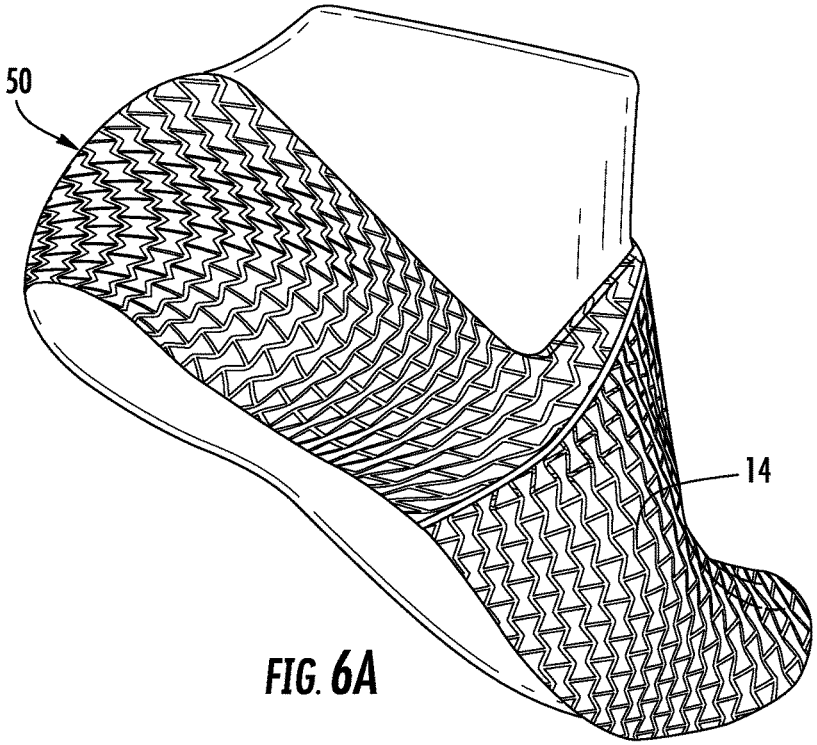
FIG. 6A is an isolated, side perspective view of the shoe upper of the article of footwear of FIG. 5A, showing the upper in a flexed position.
Figure 6B:
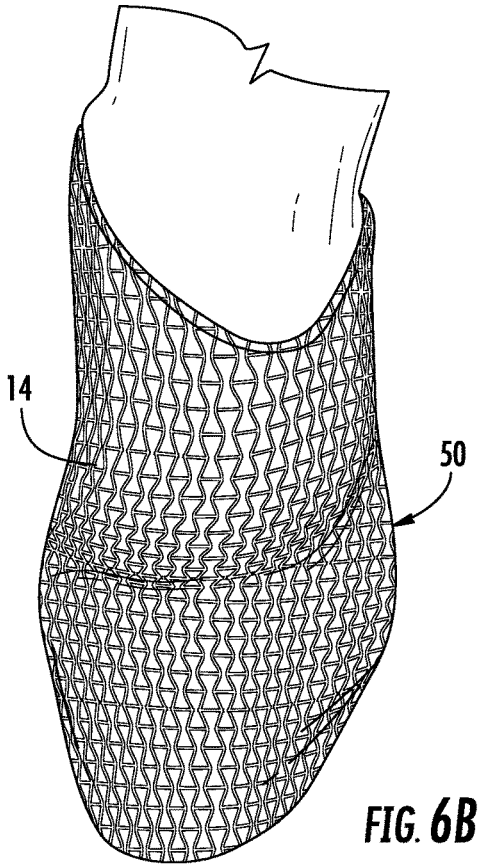
FIG. 6B is a front perspective view of the shoe upper of the article of footwear in FIG. 6A.

FIGS. 6A and 6B show the shoe upper 50 of the article of footwear of FIGS. 5A-5D during an athletic activity, such as walking or running, where the foot of the wearer bends and flexes during the activity. As shown, the auxetic arrangement 14 allows the shoe upper 50 to continue to adhere closely (i.e., to contour) to the surface of the wearer's foot even as the foot flexes during athletic activity, with only limited bending or creasing of the auxetic arrangement 14.

Figure 7A:
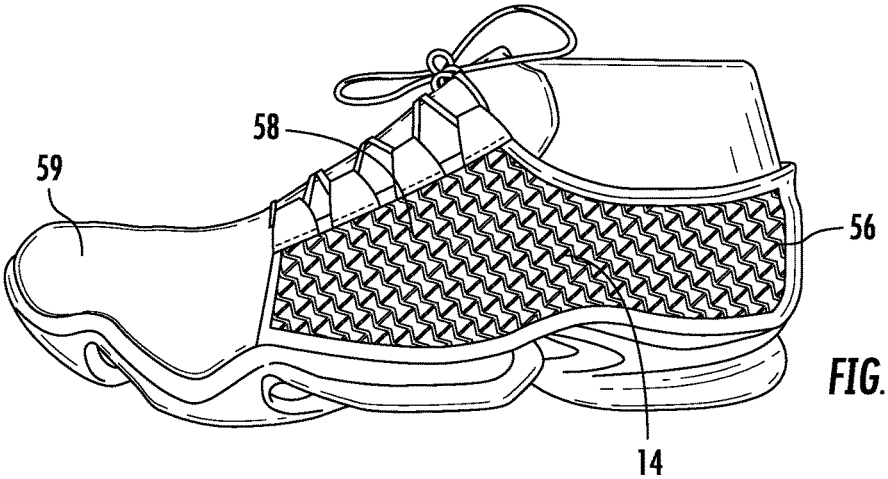
FIG. 7A is a side perspective view of an article of footwear showing an upper incorporating an auxetic arrangement.
Figure 7B:
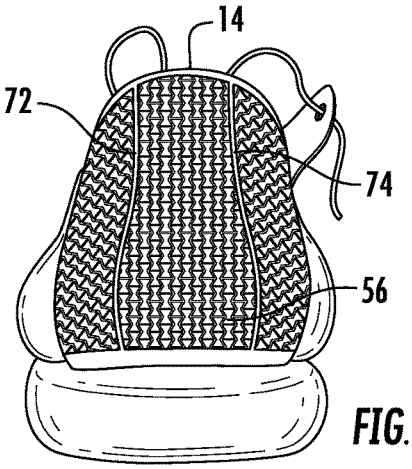
FIG. 7B is a rear view of an article of footwear showing an upper incorporating an auxetic arrangement.
Figure 7C:
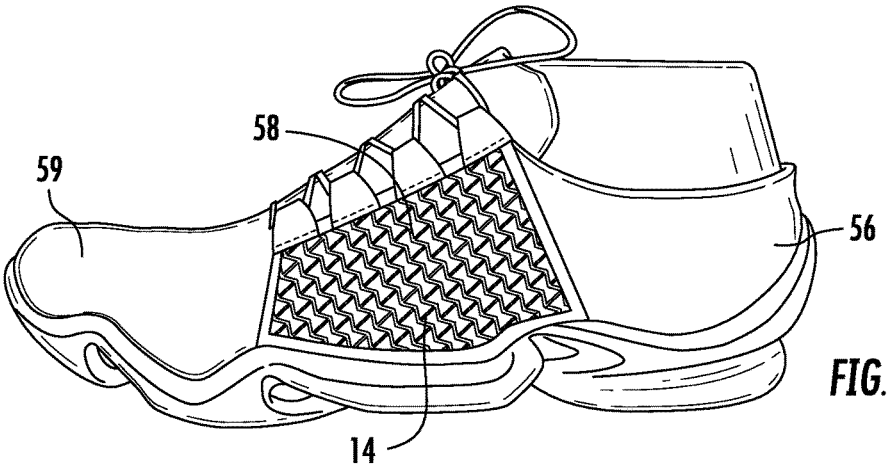
FIG. 7C is a side perspective view of an article of footwear showing an upper incorporating an auxetic arrangement.

FIGS. 7A-8C show various exemplary alternative embodiments in which the auxetic arrangement 14 is used to form only a portion of the shoe upper 50. In FIGS. 7A-7B, the auxetic material forms the heel 56 and midfoot portions 58 of the shoe upper, but does not extend to the forefoot portions or toes. In this embodiment, a hot melt is included in the inner portion of the auxetic cells, as discussed above, causing the auxetic material to be more resilient and offer additional support. Additionally, as shown in FIG. 7B, two seams 72, 74 are provided in the heel portion 56 of the shoe, allowing the auxetic cells 26 to be positioned in a preferred orientation on the heel and both sides of the midfoot portion. This preferred orientation configures the shoe to anticipate forces that may act upon the shoe and associated directions where expansion or contraction of the panel with the auxetic arrangement 14 is most likely to be needed. FIG. 7C shows an alternative embodiment where the auxetic arrangement 14 is only provided on the midfoot portion 58 of the shoe, and does not extend back to the heel 56 or forward to the toe 59.

Figure 8A:
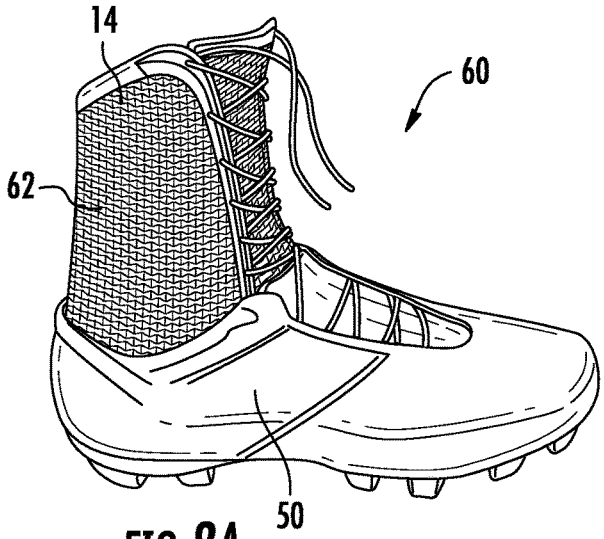
FIG. 8A is a side perspective view of an article of footwear showing an upper incorporating an auxetic arrangement in an ankle portion.
Figure 8B:
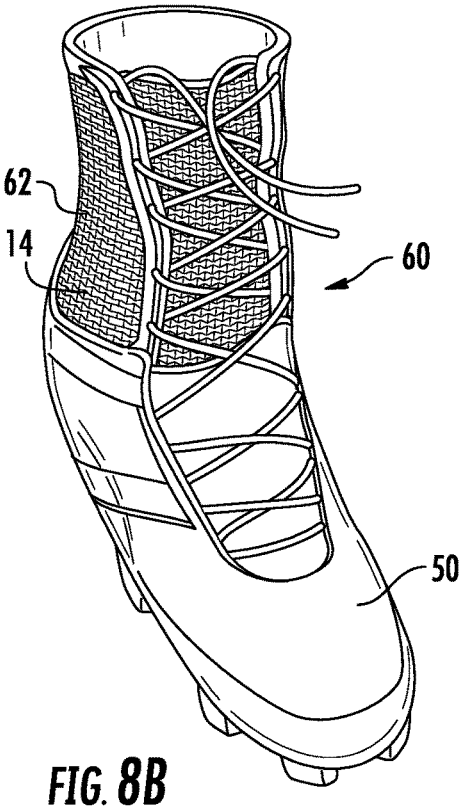
FIG. 8B is a front perspective view of the article of footwear of FIG. 8A.
Figure 8C:
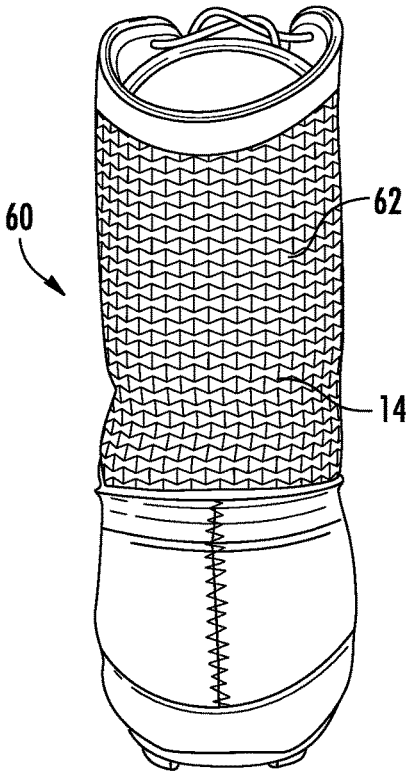
FIG. 8C is a rear view of the article of footwear of FIG. 8A.

FIGS. 8A-8C show another exemplary embodiment of footwear including the auxetic arrangement 14 described above. In this exemplary embodiment, the auxetic arrangement 14 is provided on an upper ankle portion 62 of a high top cleat 60. The auxetic arrangement 14 extends completely around the ankle region without extending to the heel, midfoot, or toe region of the cleat 60. The auxetic arrangement 14 is not only provided on the side of the ankle portion 62, but is also included on the tongue. The auxetic arrangement 14 on the ankle portion 62 may be provided as a two-piece construction, with one piece provided on the tongue, and another piece provided on the remainder of the ankle portion 62. Accordingly, no seams are required in the ankle region other than where the auxetic arrangement 14 connects to the other portions of the upper 50. Because the auxetic arrangement 14 easily conforms to the curvatures of the wearer's ankle, the auxetic arrangement acts as an ankle wrap on the wearer's ankle when the laces of the cleat 60 are tightened. Again, depending on the desired fit and support level, the cells of the auxetic layer 20 may be filled with a resilient material or may be void of material.

Garments with Auxetic Structure

Figure 9A:
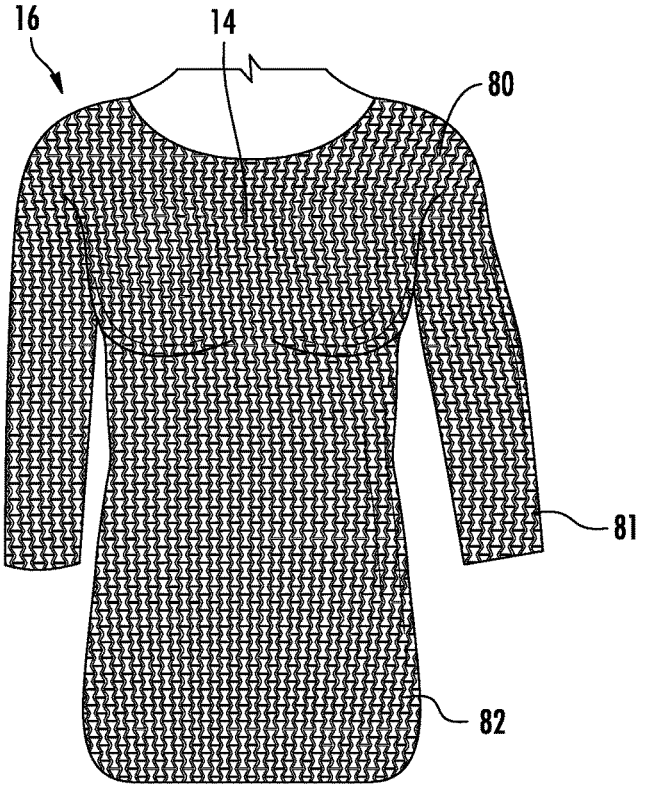
FIG. 9A is a front view of an article of apparel showing a shirt incorporating an auxetic arrangement.
Figure 9C:
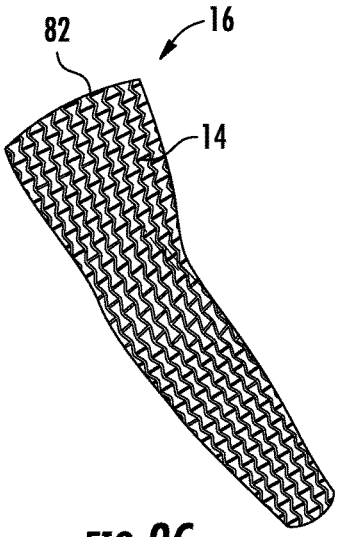
FIG. 9C is a side view of an article of apparel showing an arm sleeve incorporating an auxetic arrangement.
Figure 9B:
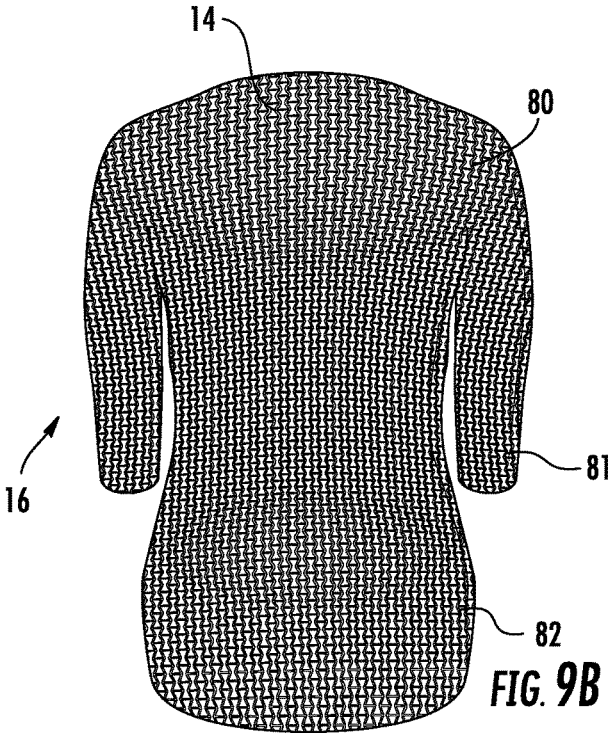
FIG. 9B is a rear view of the article of apparel of FIG. 9A.

With reference to FIGS. 9A-9C, an exemplary embodiment of an article of apparel 16 is shown in the form of a shirt 80 including one or more panels formed the auxetic arrangement 14 described above. In the embodiment of FIGS. 9A-9B, the auxetic arrangement 14 extends over the entire surface of the shirt 80. However, in other alternative embodiment, the auxetic arrangement 14 may be provided on only certain areas of the shirt 80, such as the arms 81, the chest portion, the back portion, and/or the abdomen portion. As described previously, the auxetic layer 20 of the auxetic arrangement 14 may be formed from a molding process or may be formed by a printing process. If a printing process is used the auxetic layer 20 may be directly printed on the base layer 22, and the auxetic layer 20 will typically be much thinner than if the auxetic layer is a molded structure. For example, if the auxetic layer is printed, the thickness of the auxetic layer may be less than 1 mm.

FIG. 9C shows an alternative exemplary embodiment wherein the article of apparel 16 is an arm sleeve 82 that is separate from a shirt.

Figure 10A:
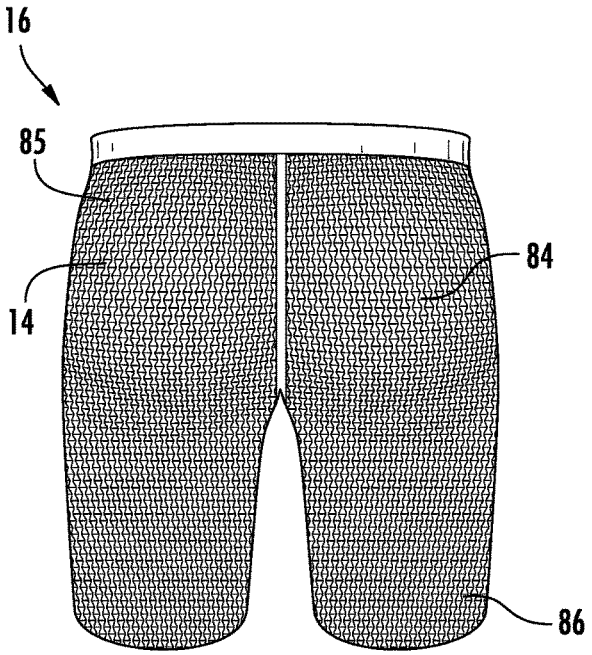
FIG. 10A is a front view of an article of apparel showing shorts incorporating an auxetic arrangement.
Figure 10B:
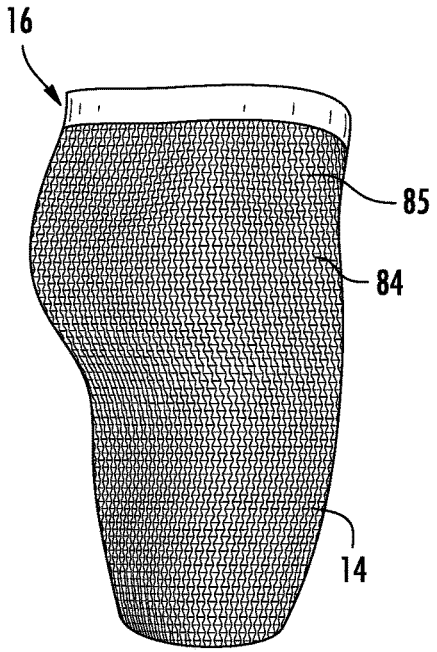
FIG. 10B is a side view of the article of apparel of FIG. 10A.
Figure 10C:
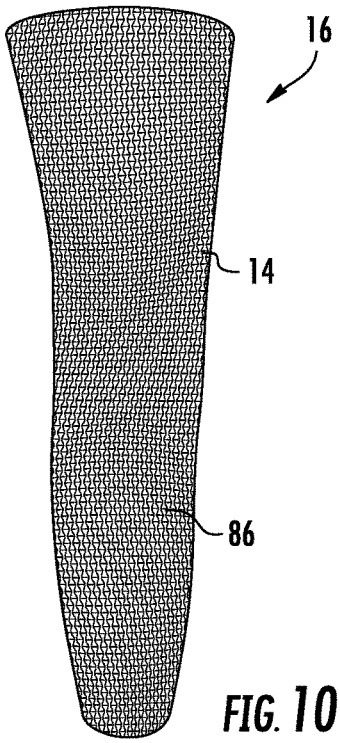
FIG. 10C is a front view of an article of apparel showing a leg sleeve incorporating an auxetic arrangement.

FIGS. 10A-10B show an alternative exemplary embodiment wherein the article of apparel 16 is a short 84. Likewise, FIG. 10C shows an alternative exemplary embodiment wherein the article of apparel 16 is a leg sleeve 86. Each of these embodiments of FIGS. 9C-10C is similar to the embodiment of FIGS. 9A-9B, but the auxetic arrangement 14 is simply provided on a different article of apparel 16.

While the foregoing description provides a few limited exemplary embodiments of the auxetic arrangement 14 and associated use in various items of apparel, it will be recognized that numerous other embodiments are possible and contemplated although such additional embodiments are not specifically mentioned herein. For example, the auxetic material disclosed herein may also be used in scarves, gloves, hats, socks, sports bras, jackets, outdoor and hunting clothing, undergarments, elbow and knee pads, braces, bands, and various other articles of apparel. Because the auxetic arrangement 14 easily conforms to various shapes and curvatures, the material provides a clean, neat appearance. Moreover, the stretching ability of the auxetic material provides for an extremely close fit for differently shaped wearers within a given size range.

Garment Fabric with Integrated Auxetic Structure Portion and Fill Portion

As described above with reference to FIGS. 2A-2C, in at least one embodiment the garment panel 18 includes an auxetic arrangement 14 comprised of an auxetic layer 20 that is mounted directly upon the base layer 22, where the auxetic layer is formed of a different type of material than the base layer 22. In at least one alternative embodiment, the auxetic arrangement 14 may be a unitary structure. For example, the base layer 22 and the auxetic layer 20 may be integrally formed as a sheet of fabric with fibers stitched together to form an auxetic structure. In such arrangement, the auxetic structure may be embedded in the fabric along with an associated fill structure. At least one embodiment of an auxetic arrangement with a unitary auxetic layer 20 and base layer 22 is described in further detail below with reference to FIGS. 11 and 12.

Figure 11:
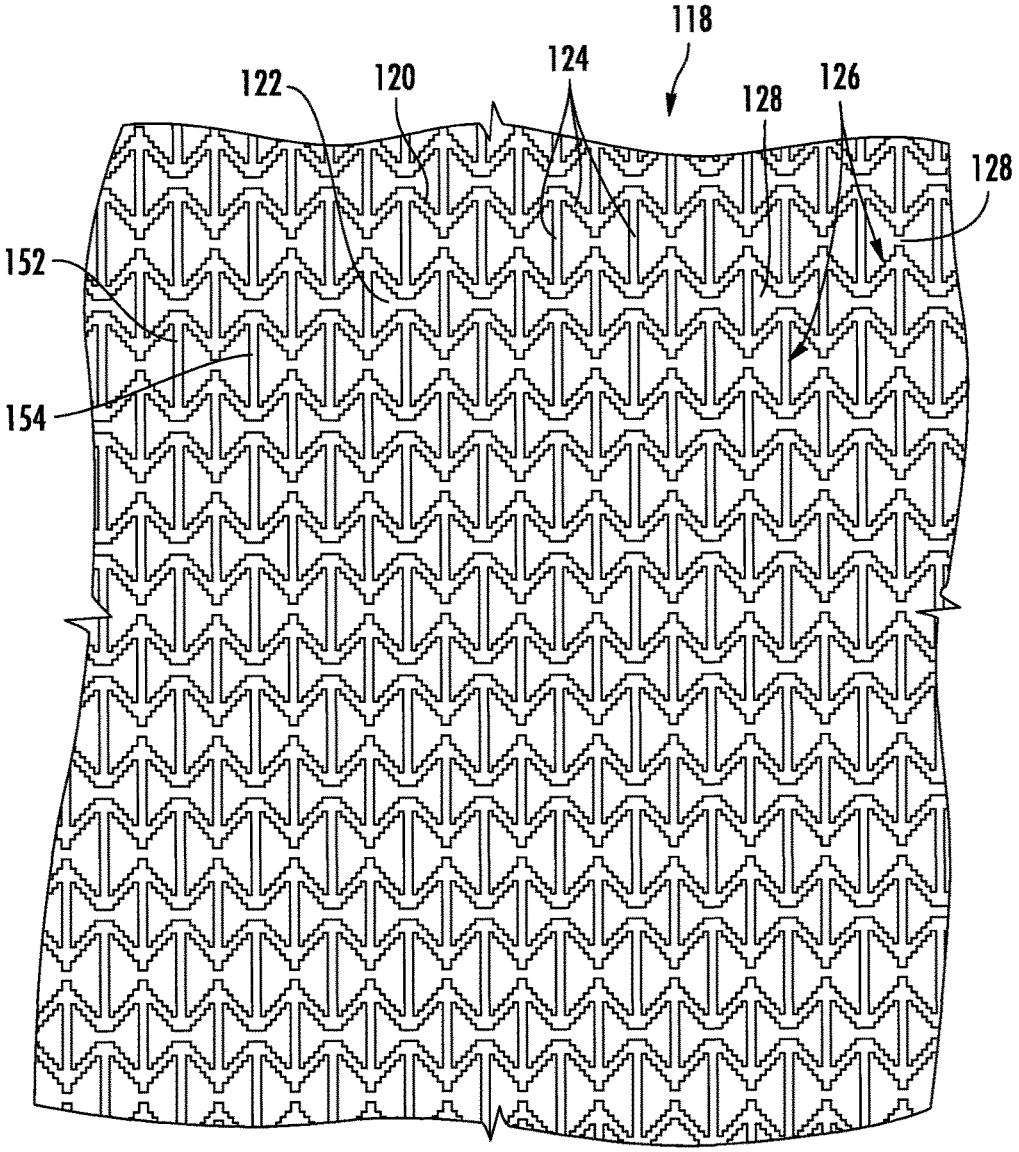
FIG. 11 is a plan view of a fabric panel incorporating an auxetic structure.
Figure 12:
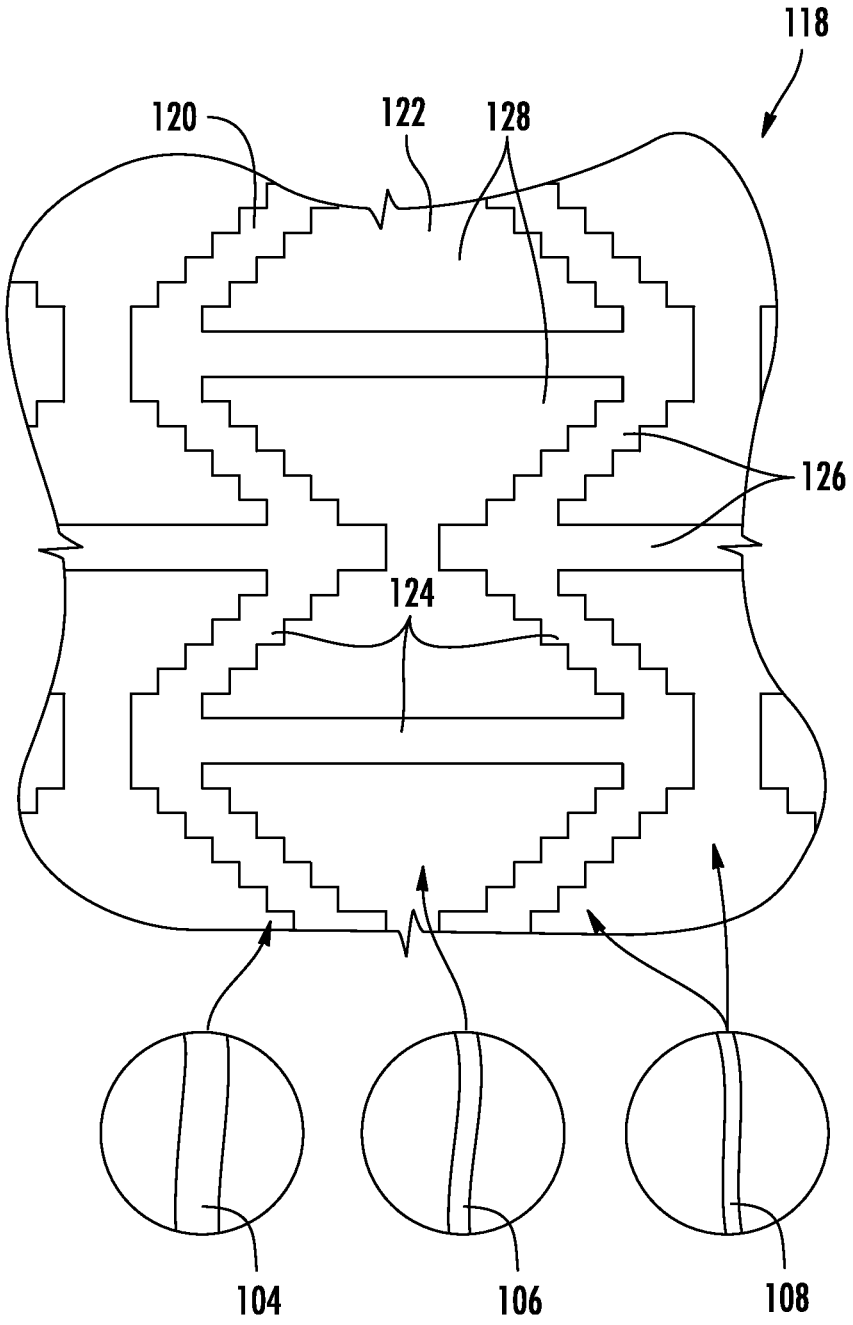
FIG. 12 is an enlarged view of the auxetic structure of the fabric panel of FIG. 11.

Referring now to FIGS. 11 and 12, a garment panel 118 is comprised of a fabric including an auxetic matrix, provided by an auxetic structure portion 120, embedded in a non-auxetic web, provided by a fill portion 122. The fabric includes a plurality of yarns, including a first yarn 104, a second yarn 106, and a third yarn 108, that are knitted, woven or otherwise stitched together or interlaced to form the fabric. The yarns 104, 106 and 108 are stitched together in such a manner that the fabric includes both the auxetic structure portion 120 and the fill portion 122. As indicated in FIG. 12, the auxetic structure portion 120 is formed of stitchings of the first yarn 104 and the third yarn 108. The fill portion 122, meanwhile, is formed of stitchings of the second yarn 106 and the third yarn 108. The term "yarn" as used herein refers to a strand or thread that is used to form a fabric.

The first yarn 104 and the second yarn 106 may be comprised of any of various different materials such as polyester, nylon, thermoplastic polyurethane (TPU), spandex, or other materials as will be recognized by those of ordinary skill in the art. The first yarn 104 may be the same as or a different material from the second yarn 106. However, the denier of the first yarn 104 is greater than the denier of the second yarn 106. As used herein, the "denier" of a yarn refers to a unit of linear mass density of fibers. In general, yarns with greater deniers are thicker than yarns with lesser deniers. In the embodiment of FIGS. 11-12, the first yarn is between 100 and 300 denier, and specifically about 150 denier; the second yarn is between 33 and 100 denier, and specifically about 50 denier. In this embodiment the denier ratio of the first yarn to the second yarn is about 3:1. The third yarn 108 is comprised of an elastomer material, such as spandex or another material comprising elastane fibers. The third yarn 108 is between 50 and 150 denier, and specifically about 100 denier. The foregoing denier ranges for the first, second and third yarns are an exemplary denier ranges for yarns used in one specific garment arrangement, and it will be appreciated that other denier ranges for the yarns may be appropriate for different embodiments and different articles of apparel. For example, if the article of apparel is a shoe or a bag, the denier of the yarns used to produce those embodiments may be significantly greater than those listed above, such as between 600 and 1600 denier. Textiles comprised of yarns in other denier ranges are also contemplated, depending on the desired look and feel of the textile used to produce a given article.

In at least one exemplary embodiment, the fabric is comprised of about 84% nylon and about 16% spandex. In yet another exemplary embodiment, the fabric is comprised of about 70% nylon and about 30% spandex. In general, the greater the percentage of spandex or other material with elastane fibers in the fabric, the greater the elasticity of the fabric.

The first yarn 104 is combined (e.g., stitched together) with the third yarn 108 to form the auxetic structure portion 120 having a first modulus of elasticity. Similarly, the second yarn 106 is stitched together with the third yarn 108 to form the fill portion having a second modulus of elasticity. The term "elastic modulus" (or "modulus of elasticity") refers to a measure of the amount of force per unit area (stress) needed to achieve a given amount of deformation (strain). The higher the elastic modulus of a material, the greater the force required to deform the material to a given degree. In contrast, the lower the elastic modulus, the lesser the force required to deform the material to a given degree. In the embodiment disclosed in FIGS. 11-12, both the auxetic structure portion 120 and the fill portion 122 include the third yarn 106 which is comprised of elastane fibers. Thus, both the auxetic structure portion 120 and the fill portion 122 are stretchable portions of the fabric panel 118. However, because the first yarn 104 used to make the auxetic structure portion 120 has a greater denier than the second yarn 106 used to make the fill portion 122, the auxetic structure portion 120 has a greater modulus of elasticity than the fill portion 122. As a result, the auxetic structure portion 120 is a more dominant structure and the fill portion 122 is a more submissive structure. Thus, the more submissive fill portion 122 tends to follow and conform to the strain on the more dominant auxetic structure portion 120 when stress forces act on the panel 118 and pull the panel 118 in various directions.

As discussed above, a greater modulus of elasticity for a given fabric may be achieved by a greater denier of yarn in that portion of fabric. In addition to the use of greater denier yarns, a greater modulus of elasticity may also be achieved by using a greater stitch density in the fabric. In other words, the greater the number of threads per square unit of fabric, the greater the modulus of elasticity. The stitch count typically includes threads extending in two different directions (e.g., both courses and wales for a knitted fabric). In the embodiments disclosed herein, the auxetic structure portion 120 may have a higher stitch density than the fill portion 122 to assist in making the auxetic structure portion 120 the more dominant portion of the fabric and the fill portion 122 the more submissive portion of the fabric.

The auxetic structure portion 120 formed from the first yarn 104 and the third yarn 108 includes a plurality of interconnected segments 124 that form a repeating pattern of reentrant shapes 126. The reentrant shapes 126 provide a raised area relative to the fill portion 122 on one side of the fabric. Each reentrant shape 126 may also be referred to herein as a "cell" defined the by the interconnected segments 124 providing a cell wall and an interior area 128 defined within the cell wall (i.e., the area within the shape formed by the interconnected segments 124). In the embodiment of FIGS. 11-12, each reentrant shape 126 is an hourglass shape such that the auxetic structure portion forms a repeating pattern of hourglass shapes. In at least one embodiment, the auxetic structure portion 120 may not provide the fabric with classic auxetic properties (e.g., a negative Poisson's ratio), or even near auxetic properties, in all embodiments of the fabric. However, the auxetic structure portion 120 does provide the fabric with a surface feature that has an auxetic shape (i.e., a repeating shape that is associated with an auxetic structure) and contributes to a lower Poisson's ratio for the fabric. However, the auxetic properties exhibited by the overall fabric depends on the respective properties of and combined interaction of the auxetic structure portion 120 and the fill portion 122.

The fill portion 122 formed from the second yarn 106 and the third yarn 108 is a substantially smooth span of fabric that is provided on the interior area 128 of each cell 126. The fill portion 122 extends between the interconnected segments of the auxetic structure portion 120 such that the fill portion 122 of each cell 126 is spread evenly through the entirety of the interior area 128. Thus, the interior area 128 of the fabric does not include any openings or holes with the exception of the tiny passages typically associated with an air permeable fabric. Accordingly, the fabric forming the panel 118, including both the auxetic structure portion 120 and the fill portion 122 is continuous; moreover, the fabric is not a mesh material, netting or other material that is configured with numerous relatively large passage formed therein. In at least one embodiment, the fabric is defined as having less than 25% of its surface area exposing direct openings through the fabric (e.g., less than 10% of the surface area exposes a hole in the fabric sheet that extends perpendicularly through the sheet relative to the plane defined by the fabric sheet when it is in an unstretched state).

The different fibers that are used to form the fabric (e.g., the first yarn 104, second yarn 106, and third yarn 108, described above) are woven, circular knit, warp knit, or otherwise stitched together. The fibers may be contemporaneously stitched together by a machine to form a two-sided fabric that may be removed from the machine as a unitary sheet of material. In at least one embodiment, the panel 118 is provided by a warp-knit fabric stitched in a manner to form both the auxetic structure portion 120 and the fill portion 122. For example, the fabric may be a warp-knit jacquard fabric. In this embodiment, the auxetic structure portion 120 is raised relative to the fill portion on one side of the fabric, and the opposite side of the fabric is substantially smooth such that the auxetic structure cannot be easily detected from the opposite second side of the fabric, and the second side of the fabric appears uniform and is smooth to the touch relative to the first side. In such an embodiment, the first yarn 104 (i.e., the yarn associated with the auxetic structure portion 120) is exposed on the first side of the fabric but not on the opposite second side of the fabric, and the second yarn 106 (i.e., the yarn associated with the filler portion 122) is exposed on both the first side and the second side of the fabric. In other embodiments, the auxetic structure portion 120 may form recessed channels relative to the filler portion 122 on the opposite side of the fabric. In such embodiments, the first yarn 104 and the second yarn 106 are exposed on both sides of the fabric.

The above-described fabric construction having the auxetic structure portion 120 and the fill portion 122 results in a garment panel 118 having auxetic or near auxetic properties. For example, in some exemplary embodiments of the fabric, the panel 118 has been shown to have auxetic properties with a Poisson's ratio of between −0.01 and −0.31, using the test method described in ASTM Designation: E132-04 (2010). In other exemplary embodiments of the fabric, the panel 118 has been shown to have near auxetic properties with a Poisson's ratio of between 0.00 and 0.15. Auxetic properties of the fabric may be determined by various factors including the scale of the auxetic structure (i.e., the size of the pattern), the shape of the auxetic structure (e.g., bow-tie, twisted star, etc.), and the fabric stitching (e.g., knit or weave).

In at least one embodiment, the garment panel 118 with auxetic or near auxetic properties is used to form a garment having a torso portion and a limb portion. For example, as shown in FIGS. 9A-9C, the garment may be a shirt 80 having a torso portion 81 (e.g., chest and abdomen portion) and a limb portion 82 (e.g., arm sleeve 82). The garment panel 118 may be used to form either the torso portion 81 or the limb portion 82. As another example, the garment may be a pant or short 84 as shown in FIGS. 10A-10C, having a torso portion (e.g., pelvis portion 85) and a limb portion (e.g., leg sleeve 86). In different embodiments, the garment may include one or more different panels 118, including one or more panels positioned on the torso portion of the garment, and one or more panels positioned on the limb portion of the garment. In yet other embodiments, the garment may include panels covering other body regions, such as the head, the neck, the hands or the foot. In yet other embodiments, the auxetic or near auxetic panels may be used in association with any of various items of apparel including helmets, hats, caps, sleeves, knee pads, elbow pads, shoes, boots, backpacks, bags, cinch sacks, and straps, as well as numerous other products configured to be worn on or carried by a person.

Figure 13:
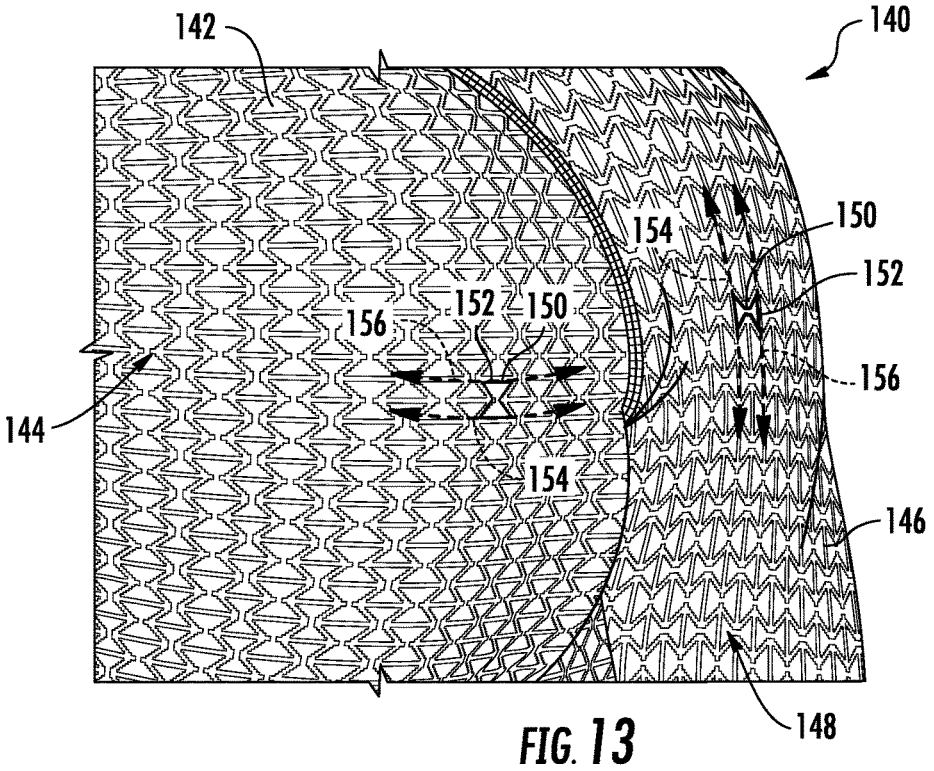
FIG. 13 is a front view of a shoulder of a shirt including the fabric panel of FIG. 11, the shirt including a first garment panel on a torso portion of the garment and a second garment panel on a sleeve portion of the garment.

With reference now to FIG. 13, in at least one embodiment, a garment is shown in the form of a shirt 140 that includes a torso panel 142 on a torso portion 144 of the shirt 140 and a limb panel 146 on a sleeve portion 148 of the shirt. Both the first garment panel 142 and the second garment panel 146 include an auxetic structure portion 120 and a fill portion 122. However, the panels 142 and 146 are oriented differently such that the auxetic hexagons 150 on the first garment panel 142 are oriented differently on the torso portion than the auxetic hexagons 150 on the second garment panel 146. As shown in FIG. 13, each auxetic hexagon 150 includes two parallel end segments 152 and 154. These parallel end segments define a "bar direction" 156 for the associated garment panel, the bar direction 156 being parallel to the end segments 152 and 154. On the first garment panel 142 the bar direction is oriented in a latitudinal direction on the garment, extending generally horizontally across the torso portion 144 (i.e., perpendicular to the spine of wearer). On the second garment panel 146 the bar direction 156 is oriented in a longitudinal direction on the garment, extending generally parallel to the longitudinal direction of the sleeve portion 148 (i.e., parallel to the humerus, radius and ulna of the wearer). As a result, when the arm of the wearer is in a relaxed position extending vertically downward, the bar direction of the second garment panel 146 is substantially perpendicular to the bar direction of the first garment panel 142. In the embodiment of FIG. 13, the torso panel 142 is directly connected to the limb panel 146, but it will be recognized that in other embodiments, the torso panel 142 may be connected to the limb panel 146 indirectly, such as by means of one or more intermediate panels. In yet other embodiments, the garment may include multiple panels on the torso portion or limb portion of the garment with the bar direction of each panel oriented differently.

Figure 14:
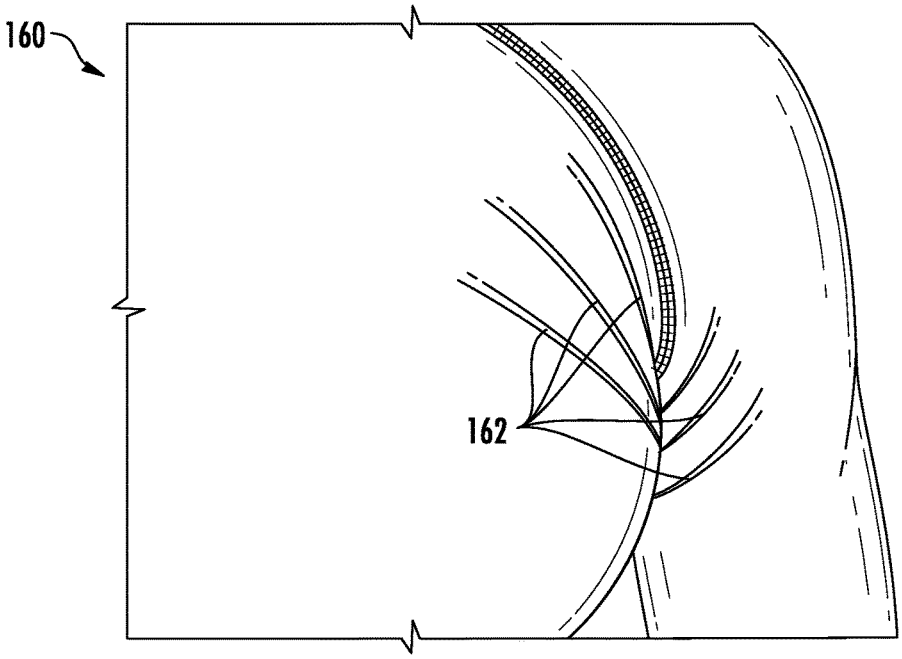
FIG. 14 (PRIOR ART)
FIG. 14 is a partial front view of a prior art shirt formed of traditional compression fabric.

Garments and other articles of apparel comprised of one or more panels made of the fabric as described above offer various advantages over garments made with traditional compression fabric such as spandex. In particular, garments including the fabric as described herein provide a better fit on the wearer with fewer tension and wrinkling points. FIG. 14 shows an exemplary shirt 160 comprised of spandex. Numerous wrinkles 162 are visible on the shirt near the underarm area of the shirt. FIG. 13 shows a similarly constructed shirt using the fabric with an auxetic structure portion and a fill portion, as described herein. As shown in FIG. 13, only a limited number of wrinkles 162 are visible in the underarm area of the shirt. The reason for this is that the fabric described herein with auxetic or near auxetic properties tends to move with the body to remove tension points, wrinkling and resistance. The fabric tends to cling to a general point on the body such that there is reduced drag on the skin. In addition to the advantages associated with appearance, athletes may find this fabric to be particularly advantageous. For example, a baseball pitcher wearing the garment may find that the fabric moves with the arm and shoulder to present reduced drag during the throwing motion.

The foregoing detailed description of one or more exemplary embodiments of the articles of apparel including auxetic structures has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A garment comprising:

at least one garment panel comprising a fabric including a first yarn having a first denier, a second yarn having a second denier, and a third yarn comprised of elastane fibers and having a third denier, the first denier greater than the second denier, the first yarn and the third yarn forming an auxetic structure comprising a pattern of interconnected segments defining cells, each cell having an interior area, wherein both the first yarn and the third yarn form each of the interconnected segments, the second yarn and the third yarn forming a fill portion extending between the interconnected segments of the auxetic structure in the interior area of each cell, wherein the second yarn and the third yarn are stitched together such that at least 75% of the interior area of each cell is covered by the second yarn or third yarn and less than 25% of the interior area exposes direct openings through the fabric.

2. The garment of claim 1 wherein the garment panel is an auxetic panel or a near auxetic panel.

3. The garment of claim 1, wherein the pattern of interconnected segments forms a pattern of reentrant shapes.

4. The garment of claim 3, the at least one garment panel including a first garment panel provided on a torso portion and a second garment panel provided on a limb portion.

5. The garment of claim 4, the first garment panel positioned on the torso portion such that a bar defined by each of the reentrant shapes is oriented in a latitudinal direction, and the second garment panel positioned on the limb portion such that the bar defined by each of the reentrant shapes is oriented in a longitudinal direction.

6. The garment of claim 1 wherein the pattern of interconnected segments forms a pattern of hourglass shapes.

7. The garment of claim 1 wherein the fabric is a warp-knit fabric.

8. The garment of claim 1 wherein the auxetic structure is raised relative to the fill portion on a first side of the fabric.

9. The garment of claim 8 wherein a second side of the fabric is substantially smooth relative to the first side of the fabric.

10. The garment of claim 9 wherein the first yarn is exposed on the first side of the fabric but not on the second side of the fabric, and the second yarn is exposed on both the first side and the second side of the fabric.

11. The garment of claim 1 wherein the first yarn is comprised of a material selected from the group comprising nylon, polyester, and thermoplastic polyurethane.

12. The garment of claim 1 wherein the first denier is less than 300 and the second denier is less than 100.

13. A garment comprising:

at least one panel comprising a first material having a first modulus of elasticity and a second material having a second modulus of elasticity, the first modulus of elasticity greater than the second modulus of elasticity;

an auxetic structure provided by the first material on the panel, the auxetic structure comprising a pattern of reentrant shapes; and a fill portion provided by the second material on the panel, the fill portion formed by a plurality of stitches positioned inside of each reentrant shape of the auxetic structure;

wherein the fill portion is a base layer of the at least one panel and the auxetic structure is an auxetic layer positioned on the base layer; and wherein the base layer and the auxetic layer are provided as a warp-knit fabric, the auxetic layer exposed a first side of the fabric but not exposed on a second side of the fabric.

14. The garment of claim 13 further comprising a third material comprised of elastane incorporated into the auxetic structure and the fill portion.

15. The garment of claim 13 wherein the panel is an auxetic panel or a near auxetic panel.

16. A garment comprising:

a torso panel comprised of a fabric including an auxetic structure and a fill portion, the auxetic structure including a plurality of interconnected segments defining a repeating pattern of reentrant shapes, each of the reentrant shapes including parallel end segments defining a bar direction, the fill portion formed by a plurality of stitches positioned inside of each reentrant shape of the auxetic structure, wherein the bar direction is arranged in a latitudinal direction on the torso panel; and a limb panel connected to the torso panel, the limb panel comprised of the fabric including the auxetic structure, the bar direction of the auxetic structure arranged in a longitudinal direction on the limb panel;

the fabric including a first yarn having a first denier, a second yarn having a second denier less than the first denier, and a third yarn comprised of elastane fibers, the parallel end segments of the auxetic structure comprised of the first yarn and the third yarn, and the fill portion comprised of the second yarn and the third yarn.

17. The garment of claim 16 wherein the fabric is a warp-knit jacquard fabric wherein the auxetic structure is raised relative to the fill portion on one side of the fabric, and an opposite side of the fabric is substantially smooth.

18. The garment of claim 14, wherein each of the reentrant shapes define an interior area, wherein the second material and the third material are knit together such that at least 75% of the interior area of each reentrant shape is covered by the second material or the third material and less than 25% of the interior area exposes direct openings through the at least one panel.

19. The garment of claim 1 wherein the fill portion is a base layer of the fabric and the auxetic structure is an auxetic layer positioned on the base layer, wherein the fabric is a warp-knit jacquard fabric with the auxetic layer exposed a first side of the fabric but not exposed on a second side of the fabric.

* * * * *